US009156267B2

(12) United States Patent
Tanda

(10) Patent No.: US 9,156,267 B2
(45) Date of Patent: Oct. 13, 2015

(54) INKJET RECORDING APPARATUS

(71) Applicant: KYOCERA Document Solutions Inc., Osaka (JP)

(72) Inventor: Tetsuo Tanda, Osaska (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/523,474

(22) Filed: Oct. 24, 2014

(65) Prior Publication Data

US 2015/0116422 A1 Apr. 30, 2015

(30) Foreign Application Priority Data

Oct. 31, 2013 (JP) ..... 2013-226580

(51) Int. Cl.
*B41J 2/165* (2006.01)

(52) U.S. Cl.
CPC ..... *B41J 2/16511* (2013.01); *B41J 2/16538* (2013.01); *B41J 2/16547* (2013.01); *B41J 2/16585* (2013.01)

(58) Field of Classification Search
CPC ..... B41J 2/16582
See application file for complete search history.

(56) References Cited

U.S. PATENT DOCUMENTS

| | | | | |
|---|---|---|---|---|
| 5,051,761 | A * | 9/1991 | Fisher et al. | 347/30 |
| 5,946,009 | A * | 8/1999 | Youn | 347/32 |
| 6,578,945 | B2 * | 6/2003 | Hashi et al. | 347/22 |
| 6,866,361 | B2 * | 3/2005 | Kuki et al. | 347/22 |
| 7,165,826 | B2 * | 1/2007 | Sugaya et al. | 347/32 |
| 7,766,449 | B2 * | 8/2010 | Watanabe | 347/29 |
| 7,857,419 | B2 * | 12/2010 | Chikamoto et al. | 347/33 |
| 8,147,031 | B2 * | 4/2012 | Shinoda | 347/32 |

FOREIGN PATENT DOCUMENTS

JP 9-150522 A 6/1997

* cited by examiner

*Primary Examiner* — Stephen Meier
*Assistant Examiner* — John P Zimmermann
(74) *Attorney, Agent, or Firm* — Stein IP, LLC

(57) ABSTRACT

An inkjet recording apparatus of the present disclosure includes a recording portion having a recording head, a cap unit that caps the recording head, a wipe unit that performs a recovering process of the recording head, a wipe moving mechanism that moves the wipe unit in a horizontal direction, and a wipe lifting mechanism that moves the wipe unit in an up-down direction. In a case where capping is performed with respect to the recording head by means of the cap unit, the cap unit is moved to the first position by means of the wipe moving mechanism, with the cap unit located over the wipe unit, and then the cap unit is lifted up by means of the wipe lifting mechanism.

7 Claims, 17 Drawing Sheets

INKJET RECORDING APPARATUS

INCORPORATION BY REFERENCE

This application is based upon and claims the benefit of priority from the corresponding Japanese Patent Application No. 2013-226580 filed on Oct. 31, 2013, the entire contents of which are incorporated herein by reference.

BACKGROUND OF THE INVENTION

The present disclosure relates to an inkjet recording apparatus that performs recording by ejecting ink onto a recording medium such as a sheet of paper.

Recording apparatuses such as facsimile machines, copiers, and printers are structured so as to record images on recording media such as sheets of paper and OHP sheets, and can be classified, according to the recording method adopted, into different types such as an inkjet type, a wire-dot type, and a thermal type. Inkjet recording methods can be classified into a serial type, in which recording is performed while a recording head scans across a recording medium, and a line-head type, in which recording is performed by a recording head fixed to the body of the recording apparatus.

An inkjet recording device of the serial type is provided with a recording head that ejects ink while scanning across a recording medium in a direction perpendicular to a recording medium conveyance direction. On the other hand, an inkjet recording apparatus of the line-head type is provided with, for each color used, an inkjet head (recording head) of the line-head type in which ejection nozzles are arranged at predetermined intervals over the entire width of a printing region perpendicular to the recording medium conveyance direction. And, by ejecting ink from the ejection nozzles corresponding to the printing position in a fashion coordinated with conveyance of the recording medium, printing can be performed over the entire recording medium.

In such inkjet recording apparatuses, in order to prevent drying up or clogging from occurring in the ink ejection nozzles of the recording head, it is typical to cap the recording head in cases where printing is not going to be performed for a long time. Moreover, a recovering process is also commonly performed by forcefully expelling ink thickened within the ink ejection nozzles out thereof through an ejection port of the recording head. Thus, inkjet recording apparatuses are provided with a recording head which ejects ink onto a recording medium, a cap unit that caps the recording head, and a wipe unit which performs a recovering process of the recording head.

In the inkjet recording device of the serial type, which has a small recording head, a cap unit and a wipe unit are arranged in the same carriage such that the cap unit and the wipe unit are moved together horizontally by a moving mechanism.

On the other hand, in the inkjet recording apparatus of the line-head type, which has a large recording head, it is sometimes difficult to arrange a cap unit and a wipe unit in the same carriage. In this case, if the cap unit and the wipe unit are designed to be moved separately, there are provided a cap moving mechanism for horizontally moving the cap unit and a wipe moving mechanism for horizontally moving the wipe unit. In addition, there are provided a cap lifting mechanism for lifting up and down (moving up and down) the cap unit and a wipe lifting mechanism for lifting up and down the wipe unit.

SUMMARY OF THE INVENTION

According to one aspect of the present disclosure, an inkjet recording apparatus is provided with a recording portion, a cap unit, a wipe unit, a wipe moving mechanism, and a wipe lifting mechanism. The recording portion has a recording head that ejects ink onto a recording medium. The cap unit is capable of reciprocating between a first position directly below the recording portion and a second position horizontally retracted from the first position, and at the first position, the cap unit caps the recording head. The wipe unit is capable of reciprocating between the first position and the second position, and when at the first position, the wipe unit performs a recovering process of the recording head. The wipe moving mechanism moves the wipe unit in a horizontal direction. The wipe lifting mechanism moves the wipe unit in an up-down direction. At the second position, the wipe unit is arranged below the cap unit. In a case where the recovering process of the recording head is performed by means of the wipe unit, the wipe unit is moved by the wipe moving mechanism from the second position to the first position with the cap unit left at the second position, and then the wipe unit is lifted up by the wipe lifting mechanism. In a case where capping is performed with respect to the recording head by means of the cap unit, the wipe unit and the cap unit are moved from the second position to the first position by the wipe moving mechanism, with the cap unit located over the wipe unit, and then the wipe unit and the cap unit are lifted up by the wipe lifting mechanism.

Still other objects and specific advantages of the present disclosure will become apparent from the following descriptions of preferred embodiments.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Hereinafter, embodiments of the present disclosure will be described with reference to accompanying drawings.

Figure 1:
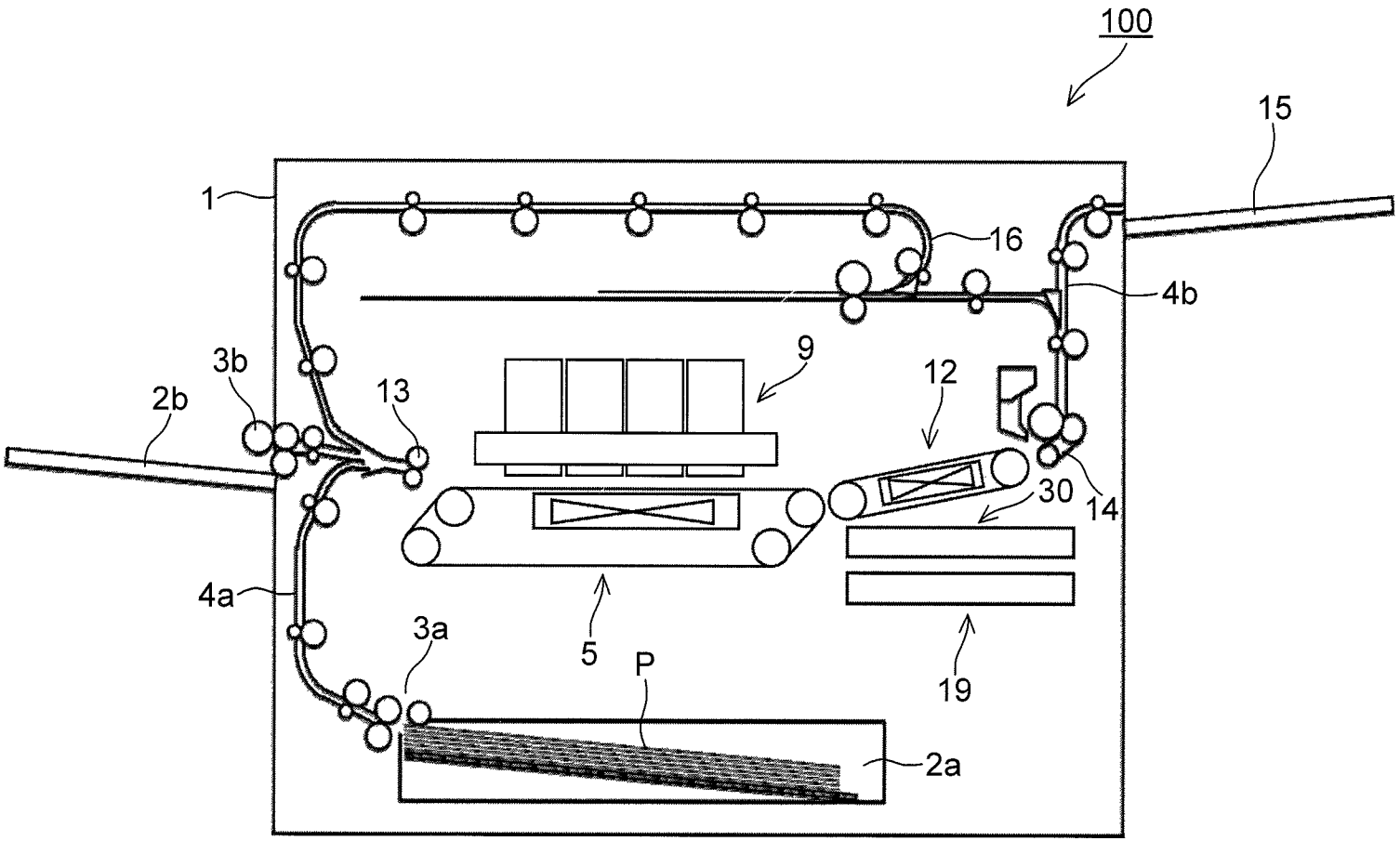
FIG. 1 is a side sectional view showing a structure of a printer according to one embodiment of the present disclosure.

With reference to FIG. 1 to FIG. 31, descriptions will be given of an inkjet printer 100 (an inkjet recording apparatus) according to one embodiment of the present disclosure. As shown in FIG. 1, in the printer 100, in a lower potion inside a printer body 1, a sheet cassette 2*a* is arranged as a sheet containing portion. Inside the sheet cassette 2*a*, sheets P, such as unprinted cut paper sheets, as one example of recording media, are stored in a stacked state. On a downstream side of the sheet cassette 2*a* with respect to a sheet conveyance direction, that is, on an upper left side of the sheet cassette 2*a* in FIG. 1, a sheet feeding device 3*a* is arranged. By the sheet feeding device 3*a*, the sheets P are fed out, one sheet after another separately, toward the upper left of the sheet cassette 2*a* in FIG. 1. The sheet cassette 2*a* can be horizontally withdrawn from the printer body 1, at its front side, to be replenished with sheets P.

At an outer left-side face of the printer body 1, a manual bypass tray 2*b* is provided. The manual bypass tray 2*b* is provided for placing thereon, for example, sheets of sizes different from the sheets P placed inside the sheet cassette 2*a*, recording media that is difficult to pass through the winding conveyance path, and recording media that a user wishes to manually feed in sheet by sheet. On a downstream side of the manual bypass tray 2*b* with respect to the sheet conveyance direction, that is, on a right side of the manual bypass tray 2*b* in FIG. 1, a sheet feeding device 3*b* is arranged. By the sheet feeding device 3*b*, sheets on the manual bypass tray 2*b* are fed out rightward in FIG. 1, separately one sheet after another.

The printer 100 is further provided inside thereof with a first sheet conveyance passage 4*a*. The first sheet conveyance passage 4*a* is located, with respect to the sheet cassette 2*a*, to the upper left of the sheet cassette 2*a*, toward which sheets are fed out from the sheet cassette 2*a*, and with respect to the manual bypass tray 2*b*, the first sheet conveyance passage 4*a* is located to the right of the manual bypass tray 2*b*. A sheet P fed out from the sheet cassette 2*a* is conveyed via the first sheet conveyance passage 4*a*, vertically upward along a side face of the printer body 1, while a sheet fed out from the manual bypass tray 2*b* is conveyed substantially horizontally rightward.

At a downstream end of the first sheet conveyance passage 4*a* with respect to the sheet conveyance direction, a registration roller pair 13 is provided. Further, in the immediate vicinity of a downstream side of the registration roller pair 13, a first belt conveyance portion 5 and a recording portion 9 are arranged. A sheet P fed out from the sheet cassette 2*a* (or the manual bypass tray 2*b*) passes through the first sheet conveyance passage 4*a* and reaches the registration roller pair 13. The registration roller pair 13 corrects oblique feeding of the sheet P, and feeds the sheet P forward toward the first belt conveyance portion 5 with timing coordinated with an ink ejecting operation performed by the recording portion 9. Note that, in the first sheet conveyance passage 4*a*, conveyance roller pairs for conveying the sheet P are appropriately provided.

In the recording portion 9, to prevent defective ejection of ink due to drying up or clogging caused in recording heads, purging is performed as necessary, that is, ink with increased viscosity is expelled from ejection nozzles (not shown) of all the recording heads when printing is started after a long period of non-operation state, and, during intermissions in printing, from any ink ejection nozzles through which less than a reference amount of ink has been ejected, in preparation for the subsequent printing operation.

On a downstream side (right side in FIG. 1) of the first belt conveyance portion 5 with respect to the sheet conveyance direction, a second belt conveyance portion 12 is arranged. The sheet P having an ink image formed thereon at the recording portion 9 is then fed to the second belt conveyance portion 12, and while it passes through the second belt conveyance portion 12, the ink that has been ejected onto the surface of the sheet P is dried.

On a downstream side of the second belt conveyance portion 12 with respect to the sheet conveyance direction, in the vicinity of a right side face of the printer body 1, a decurler portion 14 is provided. The sheet P having the ink dried in the second belt conveyance portion 12 is then fed to the decurler portion 14, where curl in the sheet P is corrected by using a plurality of rollers arranged in the sheet width direction.

On a downstream side (upper portion in FIG. 1) of the decurler portion 14 with respect to the sheet conveyance direction, a second sheet conveyance passage 4*b* is provided. The sheet P having passed through the decurler portion 14 is, unless double-side recording is requested, fed through the second sheet conveyance passage 4*b* to be delivered via a delivery roller pair onto a sheet delivery tray 15 provided at an outer right-side face of the printer 100. As in the first sheet conveyance passage 4*a*, conveyance roller pairs for conveying the sheet P are appropriately provided in the second sheet conveyance passage 4*b*.

In an upper part of the printer body 1, above the recording portion 9 and the second belt conveyance portion 12, a reverse conveyance passage 16 is provided. When double-side printing is requested, the sheet P having undergone recording on a first side thereof and having passed through the second belt conveyance portion 12 and the decurler portion 14 is caused to pass through the second sheet conveyance passage 4*b* to be then fed to the reverse conveyance passage 16. When the sheet P is sent into the reverse conveyance passage 16, the sheet conveyance direction is switched for performing printing on a second side of the sheet P, so that the sheet P passes through an upper part of the printer body 1 leftward, then through the first sheet conveyance passage 4*a* and the registration roller pair 13, to be sent again, with the second side thereof facing up, back to the first belt conveyance portion 5. In the reverse conveyance passage 16, as in the first sheet conveyance passage 4*a* and the second sheet conveyance passage 4*b*, conveyance roller pairs for conveying the sheet P are appropriately provided.

Furthermore, below the second belt conveyance portion 12, a wipe unit 19 and a cap unit 30 are arranged. When the purging mentioned above is performed, the wipe unit 19 horizontally moves to below the recording portion 9, where the wipe unit 19 wipes off the ink expelled from the ink ejection nozzles of the recording heads and collects the thus wiped-off ink. When capping ink ejection surfaces of the recording heads, the cap unit 30 horizontally moves to below the recording portion 9, where the cap unit 30 is further moved up to be attached to lower surfaces of the recording heads.

Figure 2:
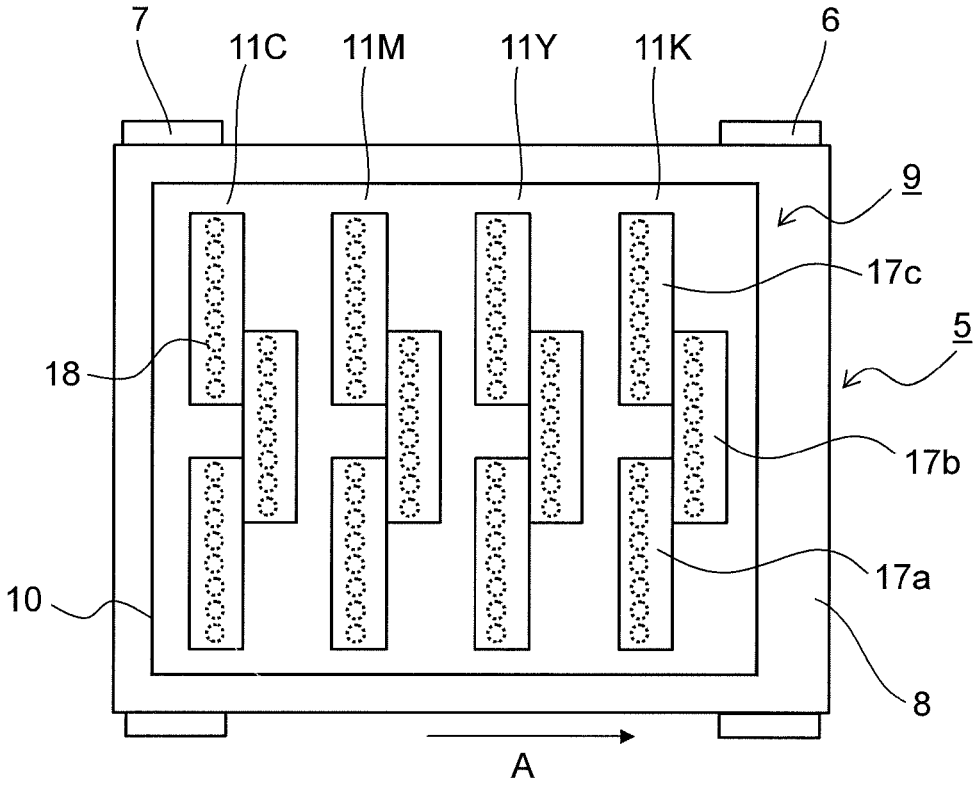
FIG. 2 is a plan view, as seen from above, showing a first belt conveyance portion and a recording portion of the printer according to the one embodiment of the present disclosure.
Figure 3:
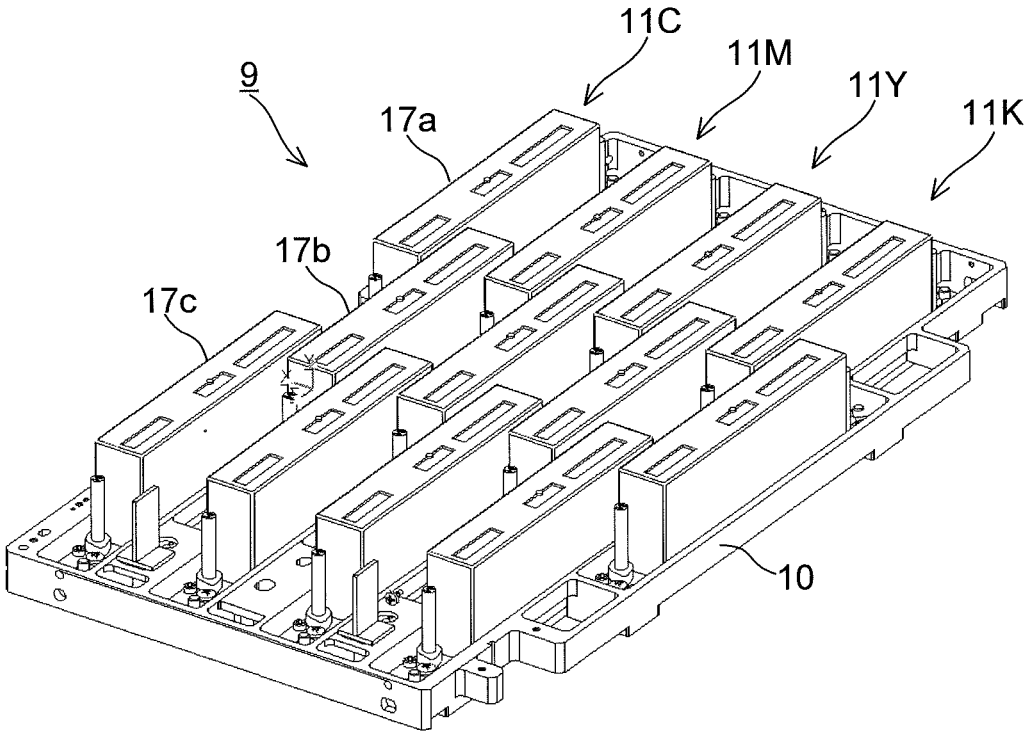
FIG. 3 is a perspective view showing a structure of the recording portion of the printer according to the one embodiment of the present disclosure.
Figure 4:
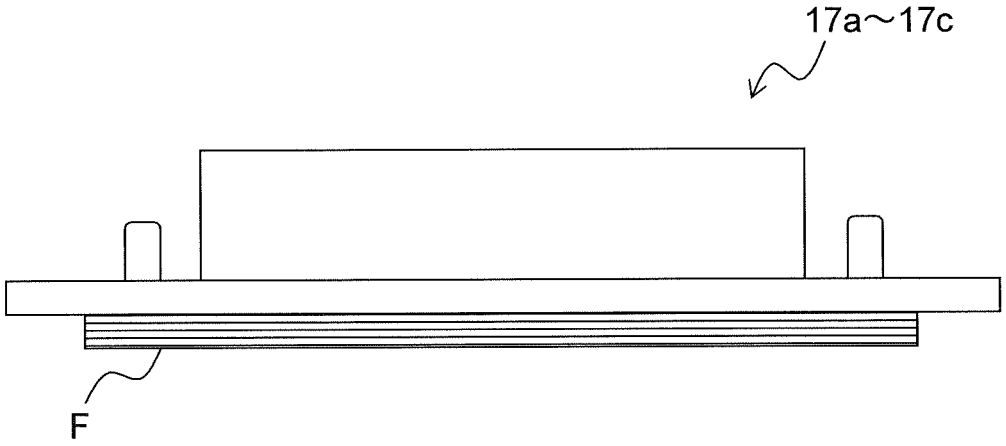
FIG. 4 is a side view showing a structure of a recording head constituting a line head of the recording portion of the printer according to the one embodiment of the present disclosure.

The recording portion 9 is provided with a head housing 10 and line heads 11C, 11M, 11Y, and 11K held on the head housing 10. The line heads 11C to 11K are supported at a height such that a predetermined gap (for example, 1 mm) is formed with respect to a conveyance surface of a first conveyance belt 8 which is wound around a plurality of rollers including a driving roller 6 and a driven roller 7, and each include, as shown in FIG. 2 and FIG. 3, a plurality of (here, three) recording heads 17*a* to 17*c* arranged in a staggered fashion along the sheet width direction (up/down direction in FIG. 2) which is perpendicular to the sheet conveyance direction. The line heads 11C to 11K have a recording region having a width that is equal to or larger than that of the sheet P conveyed, and are capable of ejecting ink from whichever of ink ejection nozzles 18 corresponding to a printing position.

Figure 5:
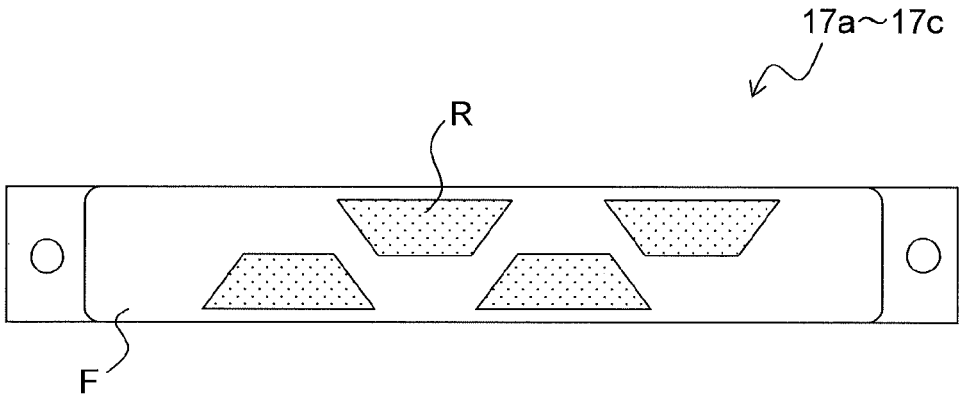
FIG. 5 is a bottom view, as seen from an ink ejection surface side, showing the recording head of the printer according to the one embodiment of the present disclosure.

As shown in FIG. 5, on an ink ejection surface F (see FIG. 4) of each of the recording heads 17*a* to 17*c*, there are provided nozzle regions R in which a large number of ink ejection nozzles 18 are arranged. The recording heads 17*a* to 17*c* are identical in shape and configuration, and thus, in FIGS. 4 and 5, the recording heads 17*a* to 17*c* are represented by a single drawing. Moreover, as shown in FIGS. 2 and 3, in each of the line heads 11C to 11K, the three recording heads 17*a* to 17*c* are arranged to overlap with each other at end portions thereof such that some of the ink ejection nozzles 18 provided in the recording heads 17*a* to 17*c* overlap with each other in the sheet conveyance direction.

The recording heads 17*a* to 17*c* constituting each of the line heads 110 to 11K are supplied with one of inks of four colors (cyan, magenta, yellow, and black), which are stored in ink tanks 20 (see FIG. 6), according to the color of the corresponding one of the line heads 11C to 11K.

According to image data received from an external computer or the like, the recording heads 17*a* to 17*c* eject ink from the ink ejection nozzles 18 toward the sheet P conveyed by being attracted to the conveyance surface of the first conveyance belt 8. As a result, on the sheet P on the first conveyance belt 8, a color image is formed by overlapping the inks of the four colors, namely cyan, magenta, yellow, and black.

Moreover, to prevent defective ink ejection due to drying up or clogging caused in the recording heads 17*a* to 17*c*, purging is performed to expel ink with increased viscosity from the ink ejection nozzles 18 of all the recording heads 17*a* to 17*c* when printing is started after a long period of non-operation state, and, during intermissions in printing, from any of the ink ejection nozzles 18 of the recording heads 17*a* to 17*c* through which less than a reference amount of ink has been ejected, in preparation for the subsequent printing operation.

The ink may be ejected from the recording heads 17*a* to 17*c* by any method, examples of which are a piezoelectric method in which ink is expelled by use of unillustrated piezoelectric elements, and a thermal inkjet method in which ink is ejected under pressure applied by means of bubbles produced by a heating element.

Figure 6:
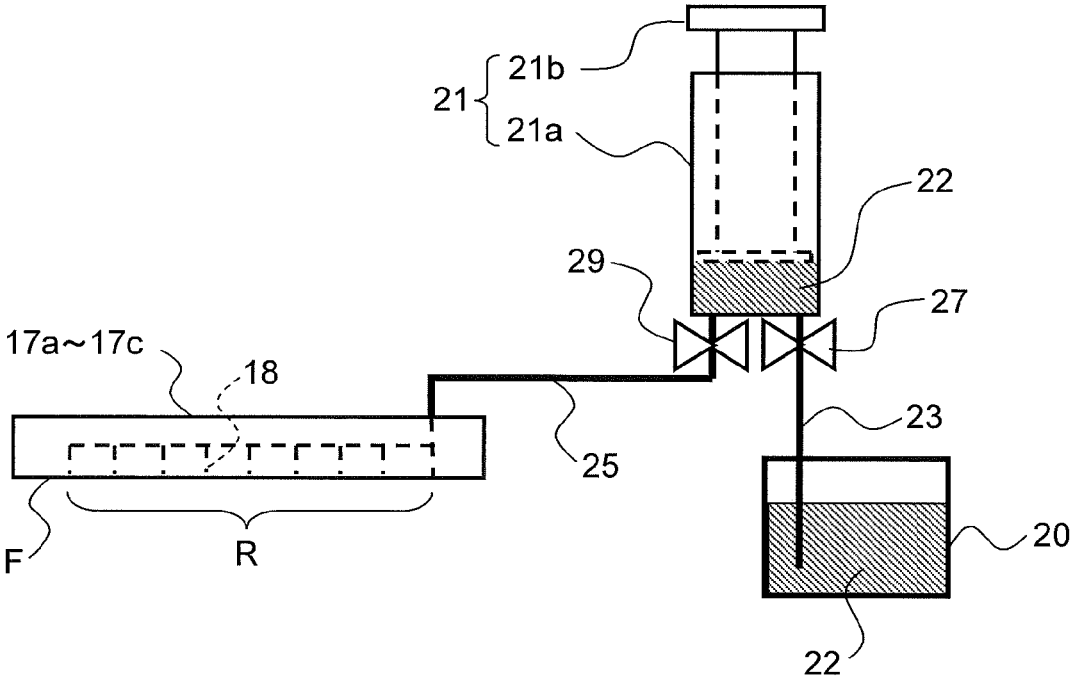
FIG. 6 is a diagram showing an ink flow passage from an ink tank to the recording head of the printer according to the one embodiment of the present disclosure.

Next, a description will be given of how ink is supplied from the ink tanks 20 to the recording heads 17*a* to 17*c* during printing and how ink is expelled from the recording heads 17*a* to 17*c* during purging. The ink flow passage shown in FIG. 6 is provided between each of the ink tanks 20 for the different colors and the corresponding recording heads 17*a* to 17*c*. Here, however, the description will focus on the ink flow passage for an arbitrary color.

As shown in FIG. 6, between the ink tank 20 and the recording heads 17*a* to 17*c*, a syringe pump 21 is arranged. The ink tank 20 and the syringe pump 21 are connected to each other through a first supply passage 23 formed of a tube member, and the syringe pump 21 and the ink ejection nozzles 18 within the recording heads 17*a* to 17*c* are connected to each other through a second supply passage 25 formed of a tube member.

The first supply passage 23 is provided with an inflow-side valve 27, and the second supply passage 25 is provided with an outflow-side valve 29. By opening/closing the inflow-side valve 27, movement of ink through the first supply passage 23 is allowed/restricted, and by opening/closing the outflow-side valve 29, movement of ink through the second supply passage 25 is allowed/restricted.

The syringe pump 21 is provided with a cylinder 21*a* and a piston 21*b*. The cylinder 21*a* is connected to the first and second supply passages 23 and 25, and through the first supply passage 23, ink 22 inside the ink tank 20 flows into the cylinder 21*a*. The ink 22 inside the cylinder 21*a* is discharged therefrom through the second supply passage 25, and the discharged ink 22 is supplied to the recording heads 17*a* to 17*c* to be expelled from the ink ejection nozzles 18 to the nozzle regions R on the ink ejection surface F.

The piston 21*b* is movable up and down by being driven by a driving device (not shown). Along the outer circumference of the piston 21*b*, a gasket (not shown) such as an O-ring is fitted to thereby prevent leakage of ink 22 from the cylinder 21*a*, and also to allow the piston 21*b* to smoothly slide along an inner circumferential surface of the cylinder 21*a*.

Ordinarily (during printing), as shown in FIG. 6, the inflow-side valve 27 and the outflow-side valve 29 are both in an open state, and with the piston 21*b* set at rest at a previously set position, the cylinder 21*a* is allowed to contain a substantially constant amount of ink. Surface tension (meniscus) between the cylinder 21*a* and the recording heads 17*a* to 17*c* causes the ink 22 to be supplied from the cylinder 21*a* to the recording heads 17*a* to 17*c*.

Figure 7:
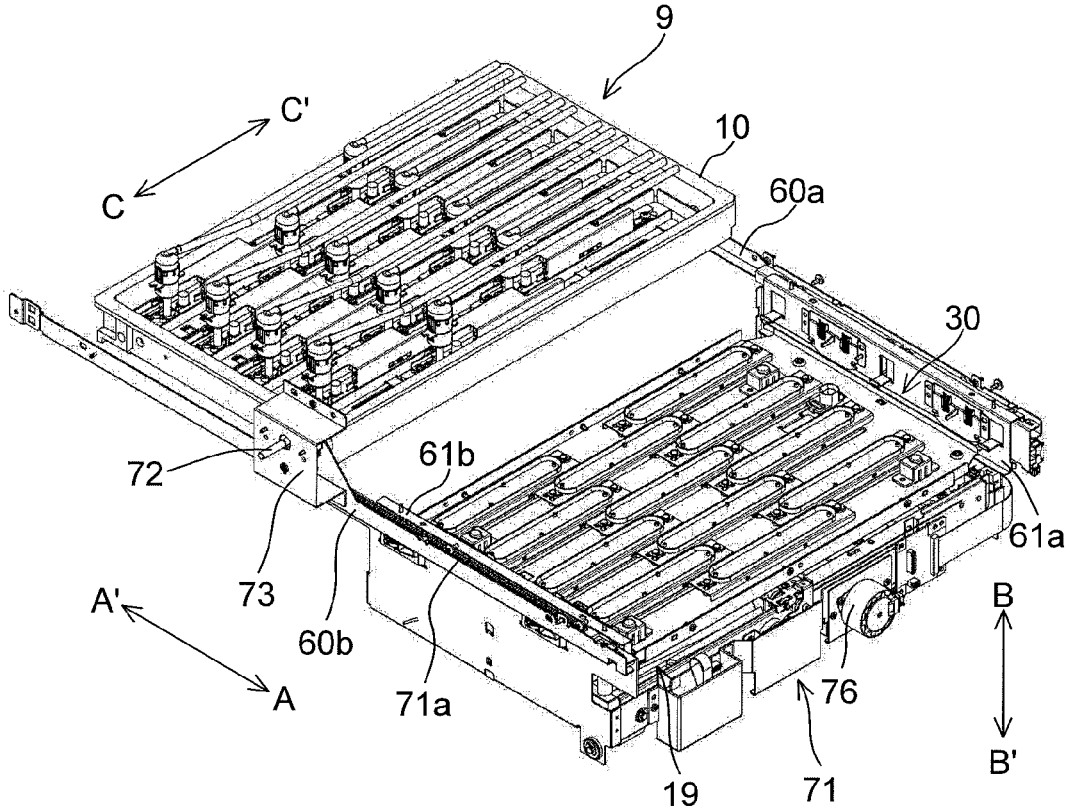
FIG. 7 is a perspective view showing structures of the recording portion, a cap unit, a wipe unit, and other components of the printer according to the one embodiment of the present disclosure.

As shown in FIG. 7, below the recording portion 9, along two end portions thereof parallel to each other in the sheet conveyance direction (arrow A direction), two guide rails 60*a* and 60*b* are fixedly provided. To the guide rails 60*a* and 60*b*, there are fixed a pair of guide plates (positioning members, guide members) 61*a* and 61*b*, respectively, and at lower end portions of the guide plates 61*a* and 61*b*, side edges of the cap unit 30 are supported. The guide rails 60*a* and 60*b* slidably support a carriage 71, and the wipe unit 19 is placed over the carriage 71.

The cap unit 30 is capable of reciprocating between a first position that is directly below the recording portion 9 and a second position (position shown in FIG. 7) that is retracted from the first position in a horizontal direction (arrow A direction), and is configured to move upward at the first position to cap the recording heads 17*a* to 17*c*.

Figure 8:
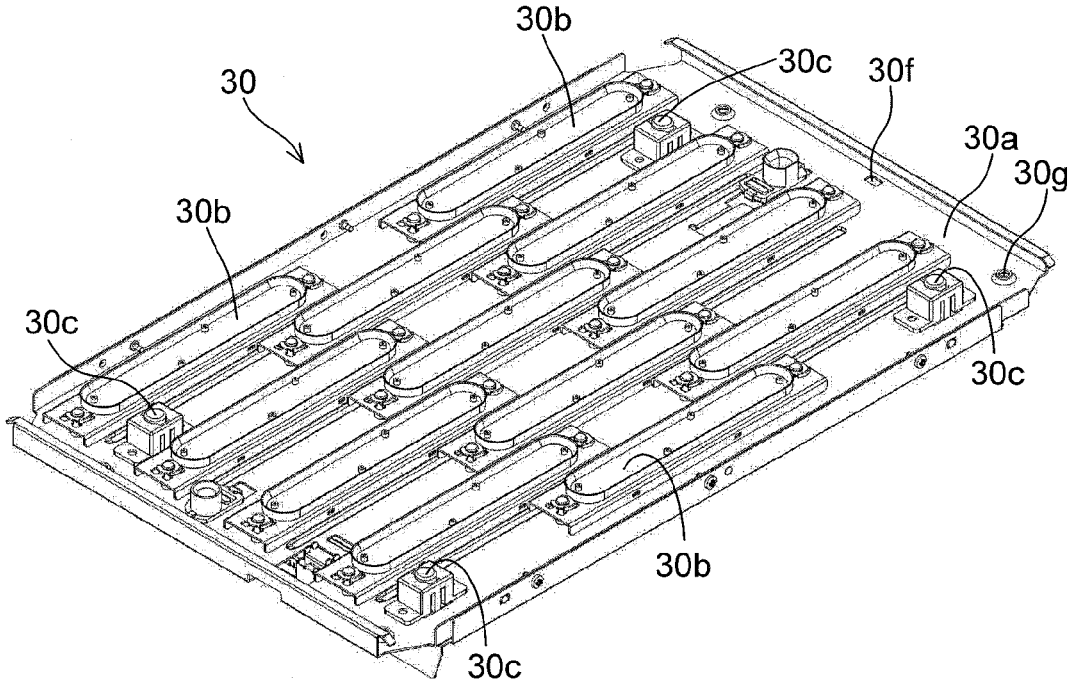
FIG. 8 is a perspective view showing a structure of the cap unit of the printer according to the one embodiment of the present disclosure.

Specifically, as shown in FIG. 8, the cap unit 30 includes a cap tray 30*a* formed of sheet metal, twelve cap portions 30*b* arranged on an upper surface of the cap tray 30*a*, each having a concave shape, and four height-direction positioning protrusions 30*c*.

Figure 9:
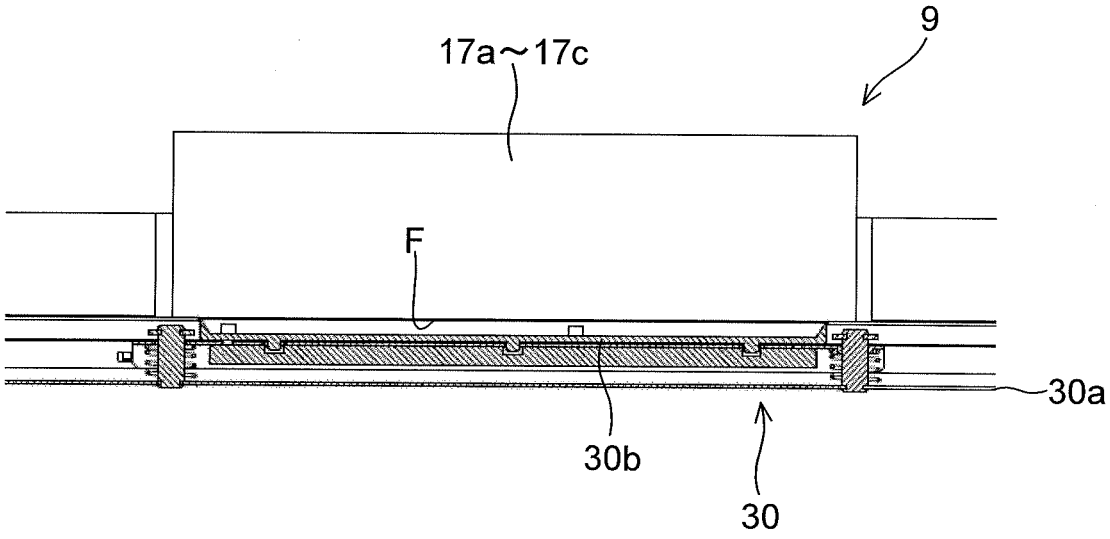
FIG. 9 is an enlarged sectional view showing a structure of and around a cap portion of the printer according to the one embodiment of the present disclosure.

The cap portions 30*b* are arranged at positions corresponding to the recording heads 17*a* to 17*c*. Thereby, when the cap unit 30 located at the first position moves upward, as shown in FIG. 9, the cap portions 30*b* cap the ink ejection surfaces F of the recording heads 17*a* to 17*c*. When the cap unit 30 is moved up toward the recording portion 9 to cap the recording heads 17*a* to 17*c*, the height-direction positioning protrusions 30*c* come in contact with the housing 10 of the recording portion 9, to thereby maintain a constant contact state between the cap portions 30*b* and the ink ejection surfaces F.

Figure 10:
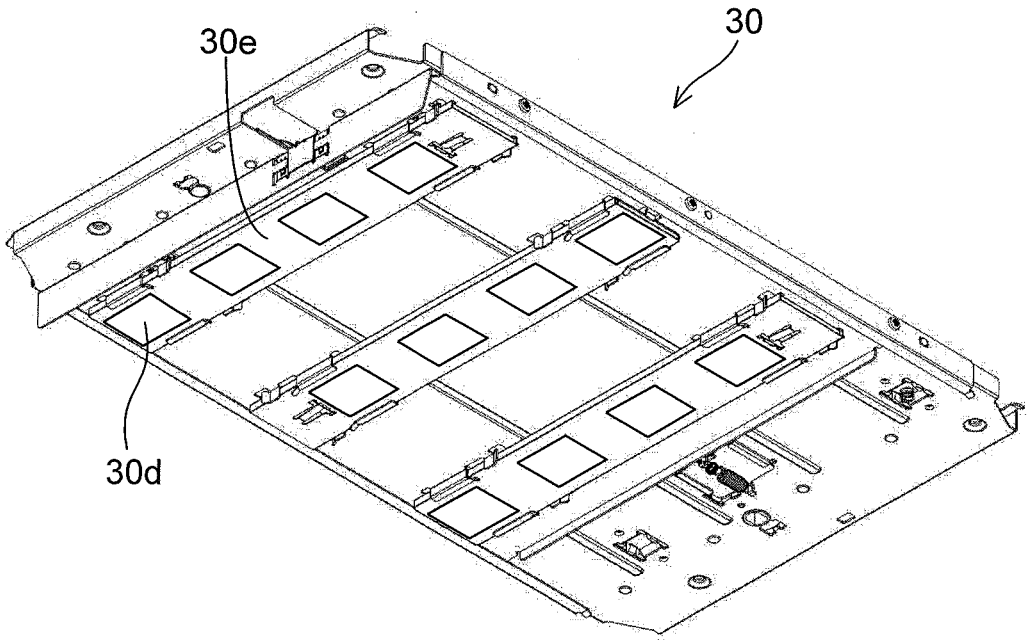
FIG. 10 is a perspective view, as seen from below, showing the structure of the cap unit of the printer according to the one embodiment of the present disclosure.

Furthermore, a lower surface of the cap unit 30 is provided with, as shown in FIG. 10, three cleaning members 30*d* formed of sponge, for example, and three holding members 30*e* formed of sheet metal to hold the cleaning members 30*d*. The cleaning members 30*d* are soaked with a humectant which is difficult to evaporate, and in each of the holding members 30*e*, four openings are formed. When the cleaning members 30*d* are touched by later-described wipers 35*a* to 35*c* of the wipe unit 19, they absorb ink adhered to the wipers 35*a* to 35*c*, and thereby the wipers 35*a* to 35*c* can be cleaned, and also, the wipers 35*a* to 35*c* can be maintained in a moist condition.

The cleaning members 30*d* are formed of a material having high liquid absorbency. As such a material, a porous material or a nonwoven fabric can be used, for example. A possible example of the porous material is SOFROUS N (brand name), which is a polyurethane sponge produced by AION Co., Ltd. Incidentally, for example, the average pore diameter of SOFROUS N is 25 μm, and the average porosity thereof is 83%. A possible example of the nonwoven fabric is a GS felt, K10021M (brand name), which is a polyester/polyurethane nonwoven fabric produced by Toray Industries, Inc.

Figure 11:
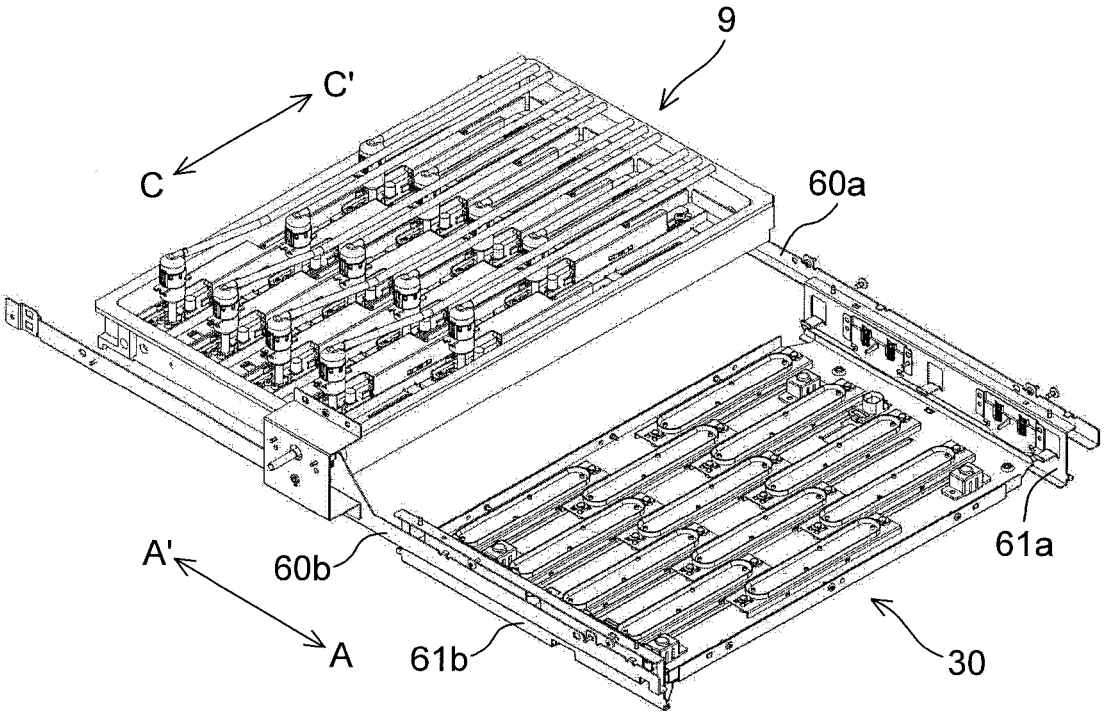
FIG. 11 is a perspective view showing structures of the recording portion, the cap unit, and other components of the printer according to the one embodiment of the present disclosure.

The cap unit 30 is, as shown in FIG. 11, configured to be positioned by the guide rails 60*a* and 60*b* when it is retracted from the first position to the second position.

Figure 12:
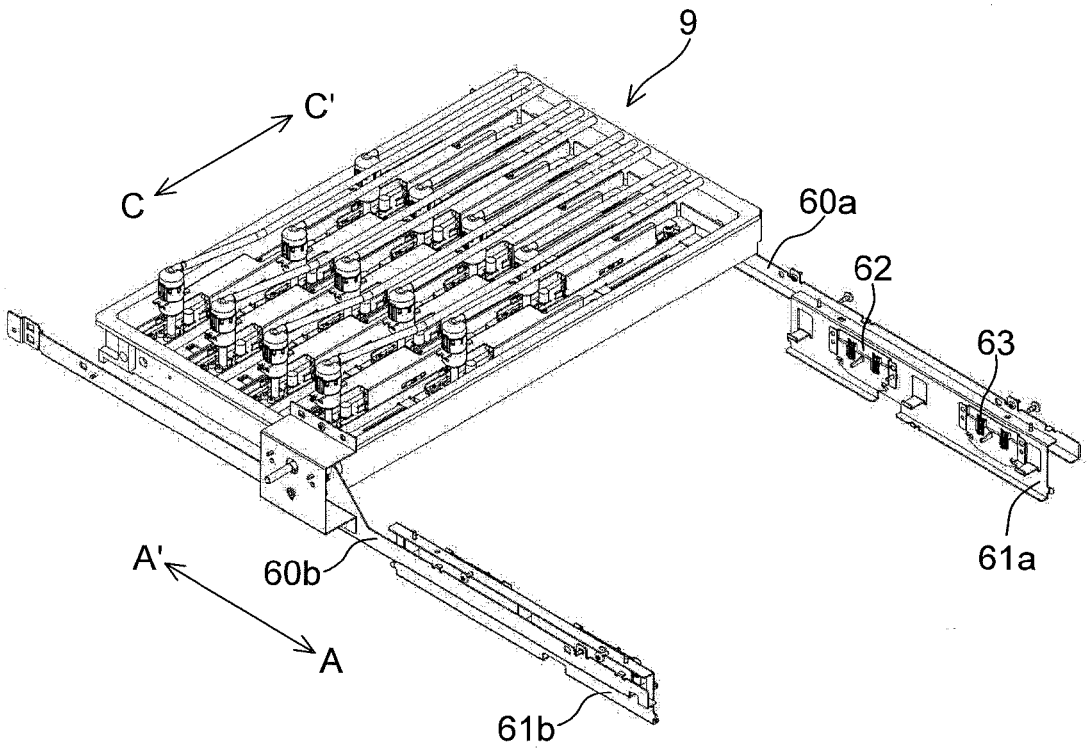
FIG. 12 is a perspective view showing structures of the recording portion and other components of the printer according to the one embodiment of the present disclosure.
Figure 13:
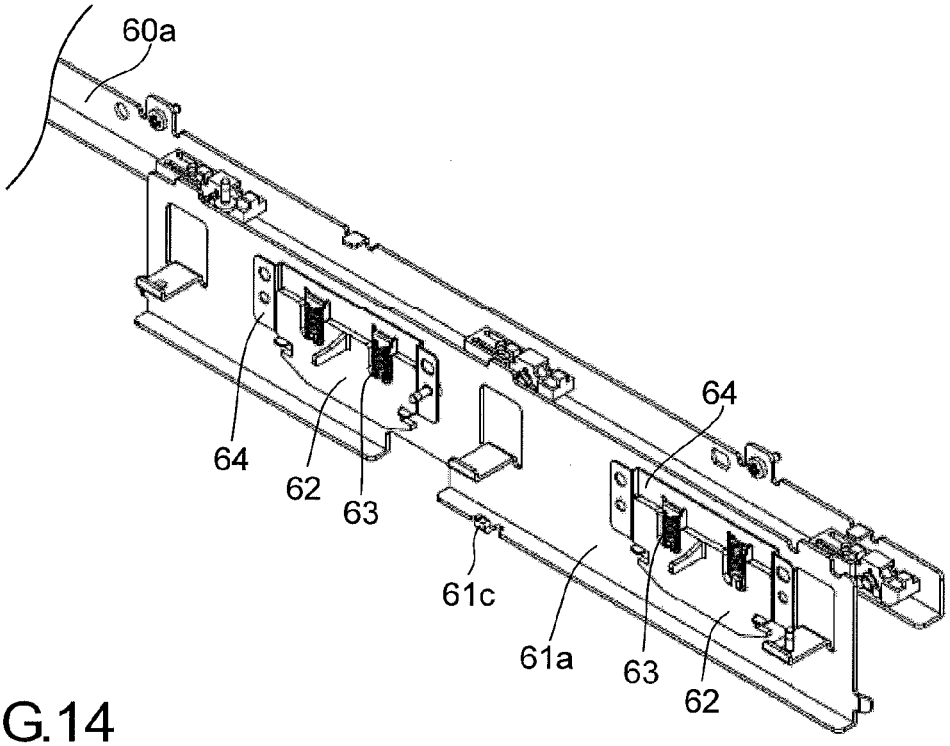
FIG. 13 is an enlarged perspective view showing a structure of and around a guide plate of the printer according to the one embodiment of the present disclosure.
Figure 14:
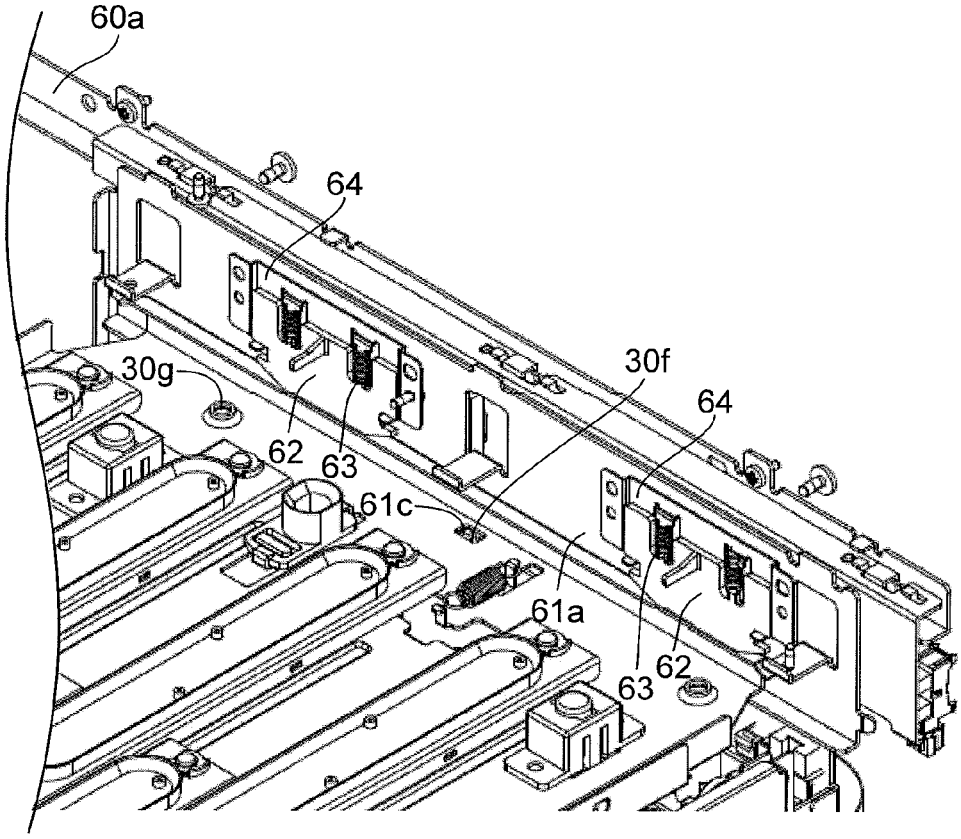
FIG. 14 is an enlarged perspective view showing a structure of and around the guide plate of the printer according to the one embodiment of the present disclosure.

Specifically, as shown in FIG. 12 and FIG. 13, the guide plates 61*a* and 61*b* are provided with a plurality of pressing pieces 62 that are formed of resin to press side end portions of the cap unit 30 downward, a plurality of compression coil springs 63 that bias the pressing pieces 62 downward, and a plurality of pressing-piece holding plates 64 that are formed of sheet metal to hold these. Furthermore, in the guide plates 61*a* and 61*b*, protruding portions (positioning portions, projecting portions) 61*c* are formed so as to project upward. When the cap unit 30 retracts from the first position to the second position, the side end portions of the cap unit 30 are biased downward by the pressing pieces 62. Then, when the cap unit 30 reaches the second position, first positioning holes 30*f* (see FIG. 8) formed in the cap tray 30*a* are positioned at positions directly above the protruding portions 61*c*. Thus, by the cap unit 30 being caused to move downward by biasing forces of the compression coil springs 63, the protruding portions 61*c* engage in the first positioning holes 30*f* as shown in FIG. 11 and FIG. 14, and thereby, the cap unit 30 is positioned.

As shown in FIG. 7, the wipe unit 19 is capable of reciprocating between the first position that is directly below the recording portion 9 and the second position that is retracted from the first position in the horizontal direction (arrow A direction), and is configured so as to move upward at the first position to perform a recovering process of the recording heads 17*a* to 17*c*.

Specifically, to an outer side of the guide rails 60*a* and 60*b*, there are attached a drive motor 72 for moving the carriage 71 in an arrow AA' direction, a gear train (not shown) that engages with the drive motor 72 and with rack teeth 71*a* of the carriage 71, and a cover member 73 that covers these. Normal rotation of the drive motor 72 causes the gear train to rotate, which in turn causes the carriage 71 and the wipe unit 19 to move from the second position to the first position. Here, the drive motor 72, the gear train, etc. constitute a wipe moving mechanism that moves the wipe unit 19 in the horizontal direction.

Figure 15:
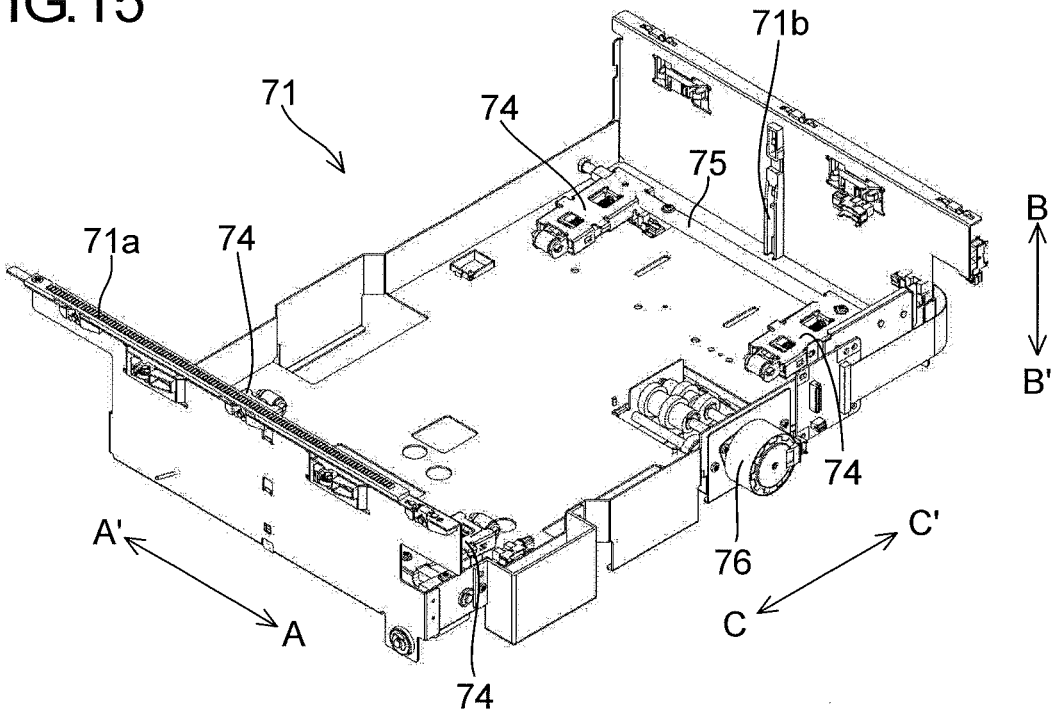
FIG. 15 is a perspective view showing a structure of a carriage of the printer according to the one embodiment of the present disclosure.
Figure 16:
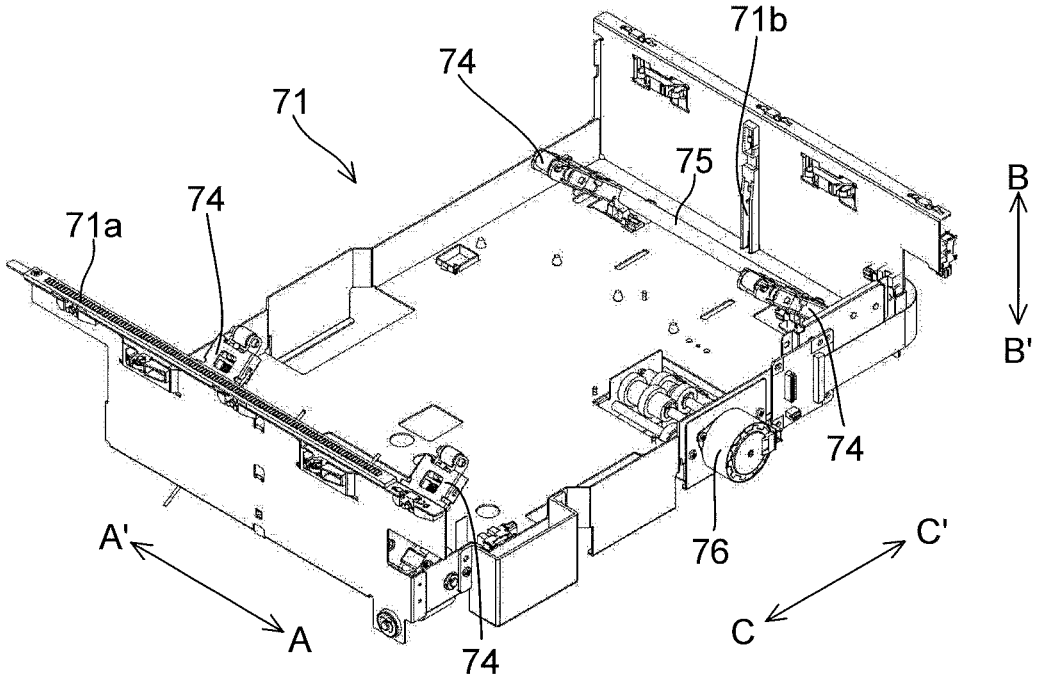
FIG. 16 is a perspective view showing the structure of the carriage of the printer according to the one embodiment of the present disclosure.

Furthermore, in four corners of the carriage 71, as shown in FIG. 15 and FIG. 16, there are provided support arms 74 that support the wipe unit 19 at its lower surface side and that also are swingable (rise or lie down). Each two adjacent ones of the support arms 74 in the arrow AA' direction are linked to each other by one of rotation shafts 75. Moreover, to an outer side of the carriage 71, there are attached a wipe lifting motor 76 for swinging the support arms 74 and a gear train or the like (not shown) that engages with gears of the wipe lifting motor 76 and the rotation shafts 75. Normal rotation of the drive motor 76 causes the gear train or the like to rotate, which in turn causes the rotation shafts 75 to rotate, so that the support arms 74 are caused to swing (rise). Thereby, the wipe unit 19 is moved upward. Here, the wipe lifting motor 76, the gear train, the rotation shafts 75, the support arms 74, etc. constitute a wipe lifting mechanism that moves the wipe unit 19 in an up-down direction (arrow BB' direction). On an inner surface of the carriage 71, there is formed a guide groove 71*b* that extends in the up-down direction, and the wipe unit 19 moves up and down along the guide groove 71*b*.

Figure 17:
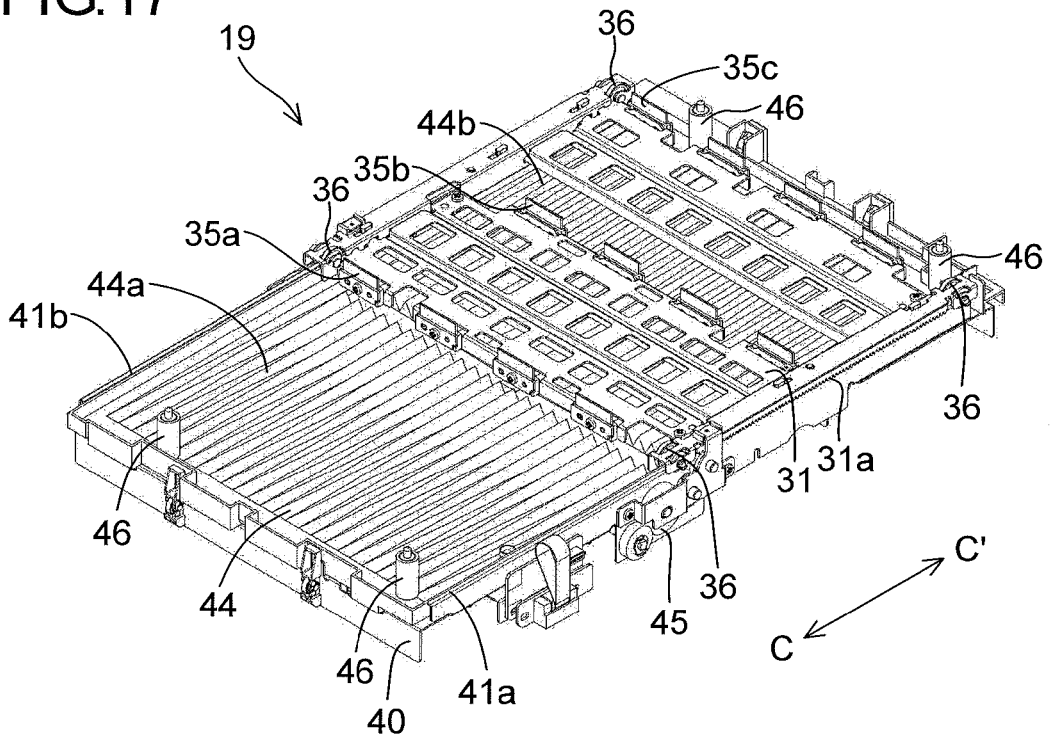
FIG. 17 is a perspective view showing a structure of a wipe unit of the printer according to the one embodiment of the present disclosure.
Figure 18:
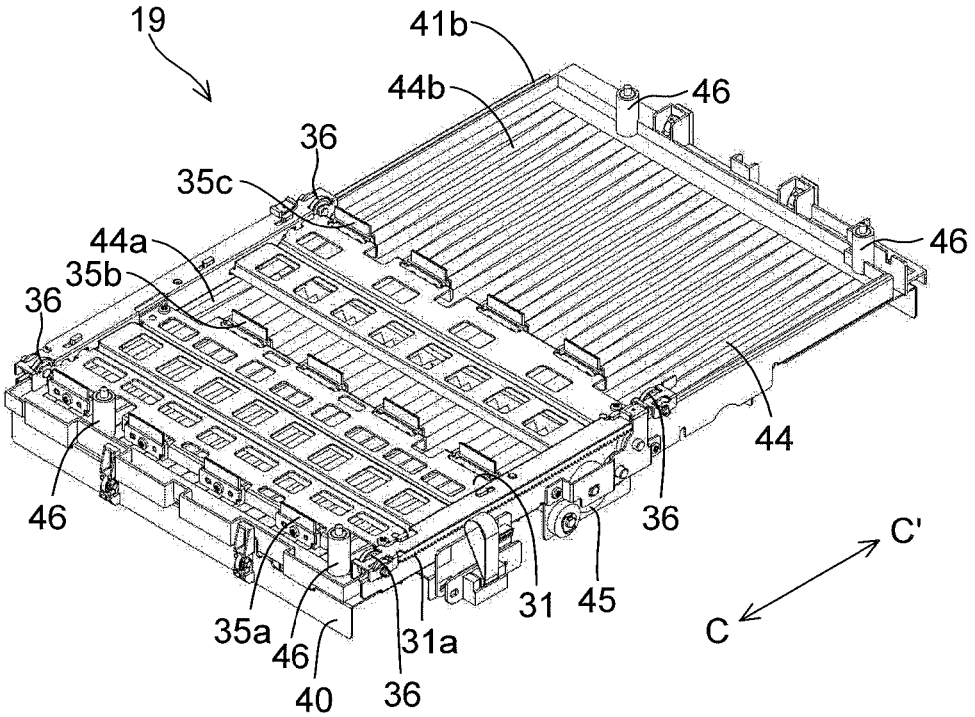
FIG. 18 is a perspective view showing the structure of the wipe unit of the printer according to the one embodiment of the present disclosure.

The wipe unit 19 is constituted by, as shown in FIG. 17 and FIG. 18, a substantially rectangular-shaped wiper carriage 31, to which a plurality of wipers 35*a* to 35*c* are fixed, and a support frame 40 that supports the wiper carriage 31.

In the support frame 40, at two opposing edges of its upper surface, there are formed rail portions 41*a* and 41*b*, with which rollers 36 provided in four corners of the wiper carriage 31 are in contact, and thereby the wiper carriage 31 is supported to be slidable with respect to the support frame 40 in an arrow CC' direction.

To an outer side of the support frame 40, there are attached a wiper carriage moving motor 45 for moving the wiper carriage 31 in the horizontal direction (arrow CC' direction) and a gear train (not shown) that engages with the wiper carriage moving motor 45 and rack teeth (not shown) of the wiper carriage 31. Normal and reverse rotations of the wiper carriage moving motor 45 cause the gear train to rotate normally and reversely, which in turn causes the wiper carriage 31 to reciprocate in the horizontal direction (arrow CC' direction).

The wipers 35*a* to 35*c* are, for example, rubber members for wiping off ink expelled from the ink ejection nozzles 18 of the recording heads 17*a* to 17*c*, respectively. The wipers 35*a* to 35*c* are each pressed from a substantially vertical direction against a wiping starting position outside the nozzle regions R (see FIG. 5) where the nozzle surfaces of the ink ejection nozzles 18 are exposed, and along with movement of the wiper carriage 31, the wipers 35*a* to 35*c* wipe the ink ejection surfaces F including the nozzle regions R in a predetermined direction (arrow C direction in FIG. 17).

The wipers 35*a* are four in number and arranged at substantially equal intervals. Likewise, the wipers 35*b* are four in number and arranged at substantially equal intervals, and the wipers 35*c* are four in umber and arranged at substantially equal intervals. The wipers 35*a* and 35*c* are respectively arranged at positions corresponding to the recording heads 17*a* and 17*c* (see FIG. 3) which constitute the line heads 11C to 11K and are located at right and left sides. The wipers 35*b* are arranged at positions corresponding to the recording heads 17*b* (see FIG. 3) which constitute the line heads 11C to 11K and are located at a center. The wipers 35*b* are fixed in a fashion such that they are staggered with respect to the wipers 35*a* and 35*c* by a predetermined distance in a direction perpendicular to the direction (arrow CC' direction) in which the wiper carriage 31 moves.

At four positions on the upper surface of the support frame 40, height-direction positioning protrusions (engaging portions) 46 are provided. When the support frame 40 is moved up toward the recording portion 9 in order for the wipers 35*a* to 35*c* to perform the operation of wiping the ink ejection surfaces F of the recording heads 17*a* to 17*c*, the height-direction positioning protrusions 46 contact the head housing 10 of the recording portion 9 to thereby maintain a constant contact state between the wipers 35*a* to 35*c* and the ink ejection surfaces F.

On the upper surface of the support frame 40, there is arranged an ink collection tray 44 for collecting waste ink wiped off from the ink ejection surfaces F by the wipers 35*a* to 35*c*. At a substantial center portion of the ink collection tray 44, an ink outlet (not shown) is formed to be located between tray surfaces 44*a* and 44*b*, which are inclined downward toward the ink outlet. The waste ink wiped off from the ink ejection surfaces F by the wipers 35*a* to 35*c* to fall onto the tray surfaces 44*a* and 44*b* flows toward the ink outlet (not shown). Then, the waste ink flows through an ink collection passage (not shown) connected to the ink outlet to be collected in a waste ink collection tank (not shown).

Figure 19:
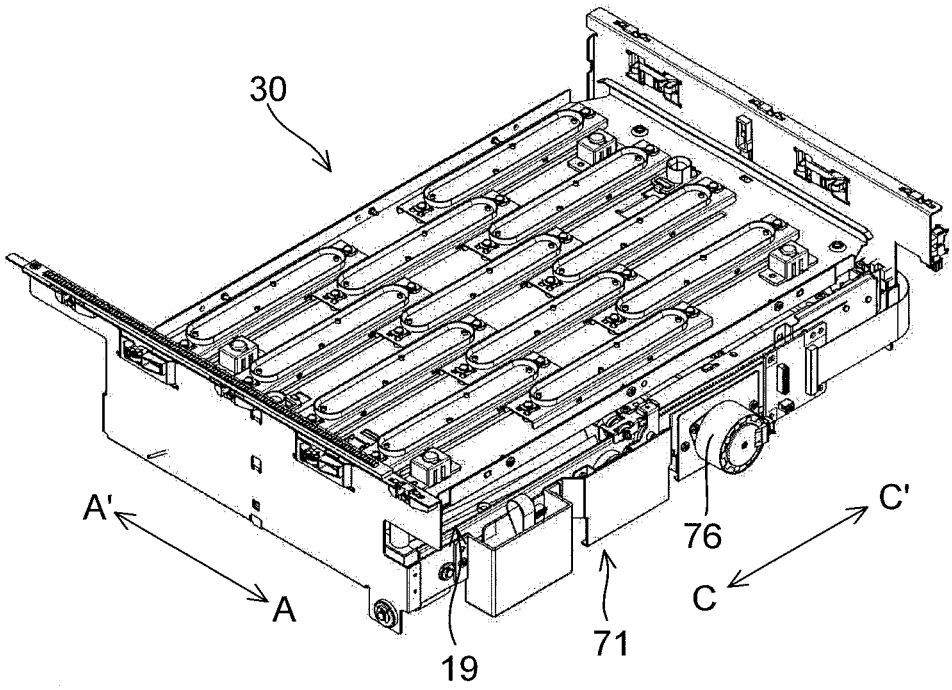
FIG. 19 is a perspective view showing the structures of the cap unit, the wipe unit, and the carriage of the printer according to the one embodiment of the present disclosure.
Figure 20:
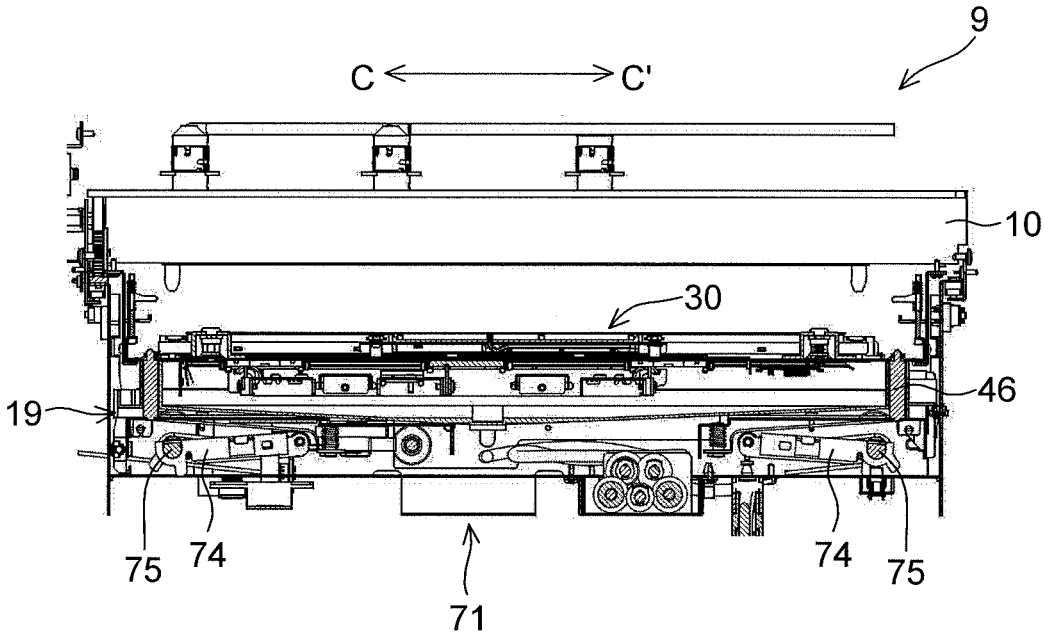
FIG. 20 is a sectional view showing states of the cap unit, the wipe unit, and other components in a printing operation of the printer according to the one embodiment of the present disclosure.
Figure 21:
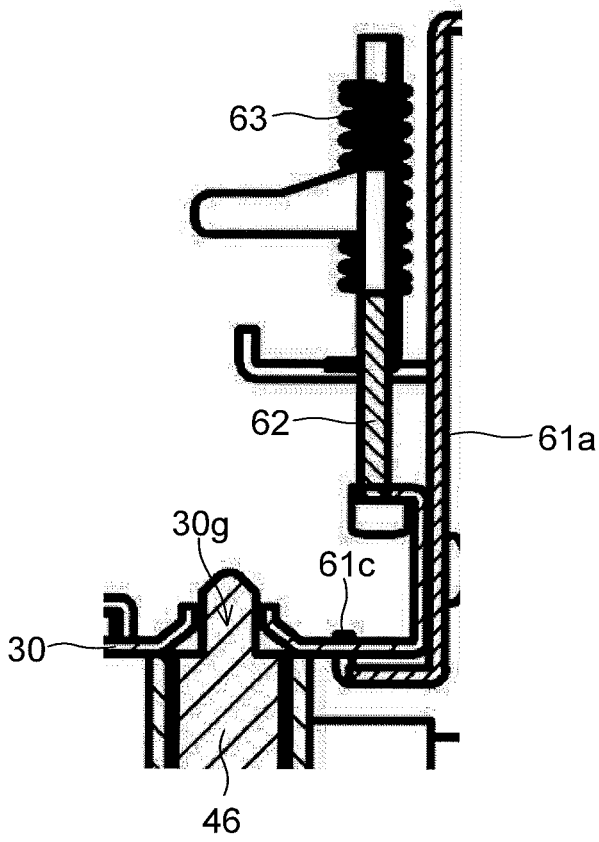
FIG. 21 is a partial enlarged view showing a part of FIG. 20.

As shown in FIG. 19, when at the second position, the wipe unit 19 is arranged directly below the cap unit 30. During a printing operation, the wipe unit 19 is in contact with the lower surface of the cap unit 30. Specifically, during the printing operation, as shown in FIG. 20, the support arms 74 swing (rise) to just a slight angle, moving the wipe unit 19 upward by just a slight distance. As a result, the height-direction positioning protrusions 46 are, as shown in FIG. 21, inserted in second positioning holes 30*g* provided in the cap tray 30*a*, and thereby, the wipe unit 19 is positioned with respect to the cap unit 30. Note that, although the cap unit 30 is lifted up by a slight distance, as shown in FIG. 21, the protruding portions 61*c* are not disengaged from the first positioning holes 30*f*.

Figure 22:
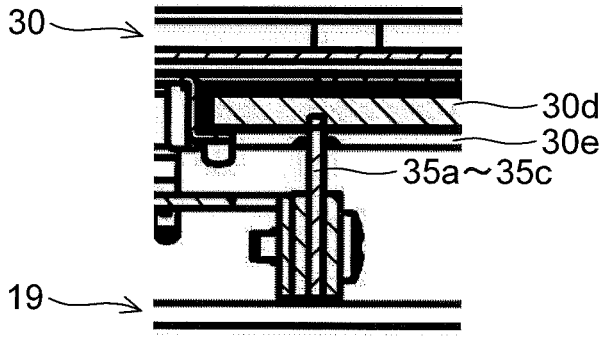
FIG. 22 is a sectional view showing a state in which an end portion of a wiper has bitten into a cleaning member in the printer according to the one embodiment of the present disclosure.

At this time, as shown in FIG. 22, by end portions of the wipers 35*a* to 35*c* of the wipe unit 19 being contacted (bitten) by the cleaning members 30*d*, it is possible to maintain the wipers 35*a* to 35*c* in a moist condition. Note that the height-direction positioning protrusions 46 contact the cap tray 30*a*, and thereby the amount (about 1 mm) of intrusion of the wipers 35*a* to 35*c* into the cleaning members 30*d* is maintained constant.

Figure 23:
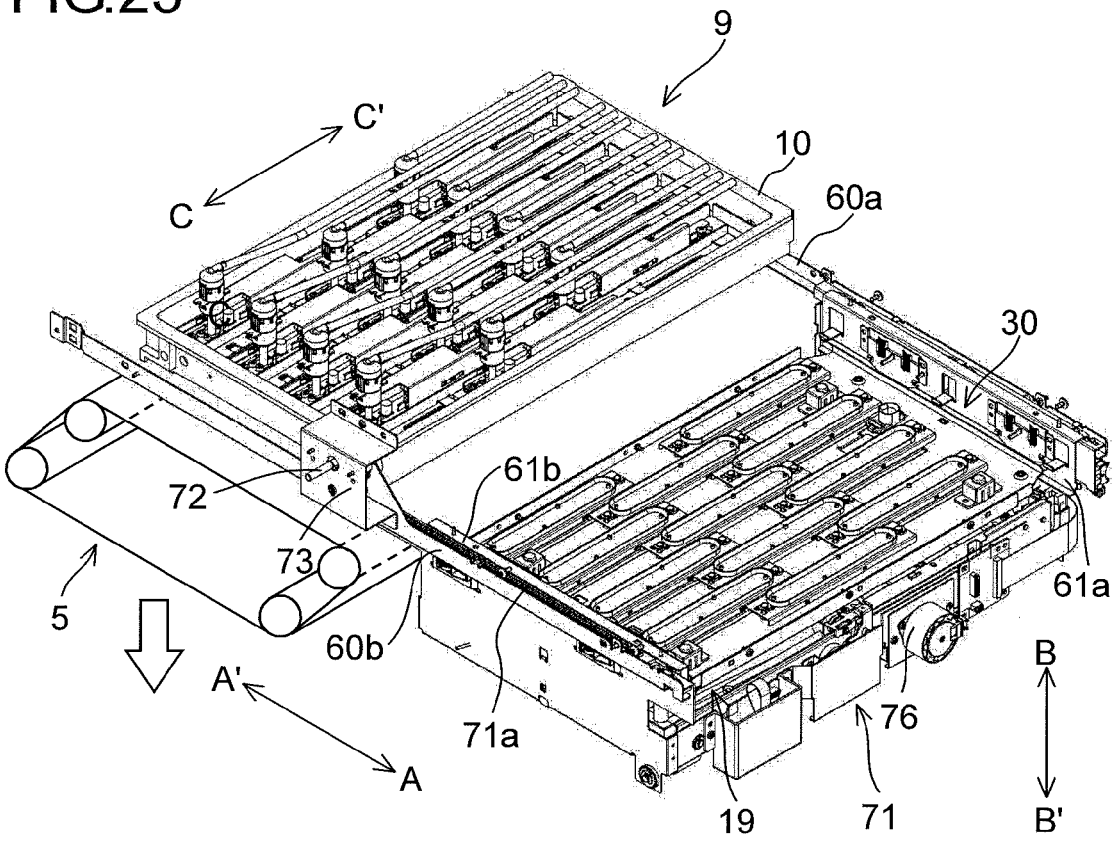
FIG. 23 is a perspective view showing a state in which the first belt conveyance portion of the printer according to the one embodiment of the present disclosure has moved down.

Next, a description will be given of an operation of attaching the cap unit 30 to the recording heads 17*a* to 17*c* in the printer 100 according to the present embodiment. In capping the recording heads 17*a* to 17*c* with the cap unit 30, as shown in FIG. 23, the first belt conveyance portion 5 that is arranged to face the lower surface of the recording portion 9 is lowered. Then, with the cap unit 30 arranged over the wipe unit 19, the wipe unit 19 and the cap unit 30 are moved from the second position to the first position, and thereafter, the wipe unit 19 and the cap unit 30 are lifted up, to thereby attach the cap unit 30 to the recording heads 17*a* to 17*c*.

Figure 24:
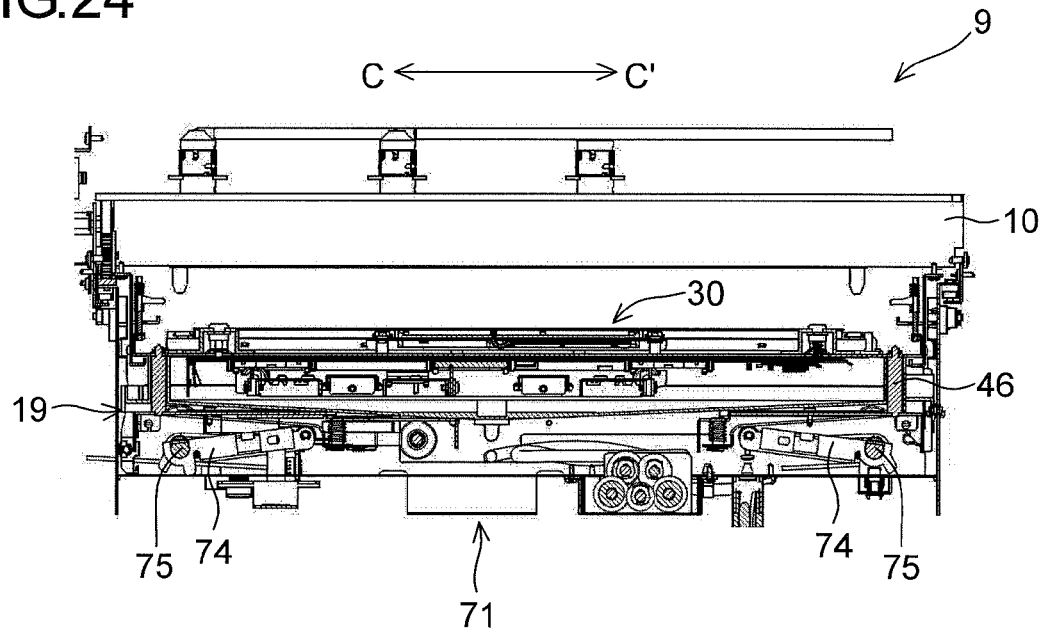
FIG. 24 is a sectional view showing a state in which the wipe unit of the printer according to the one embodiment of the present disclosure has moved further up from the state shown in FIG. 20.
Figure 25:
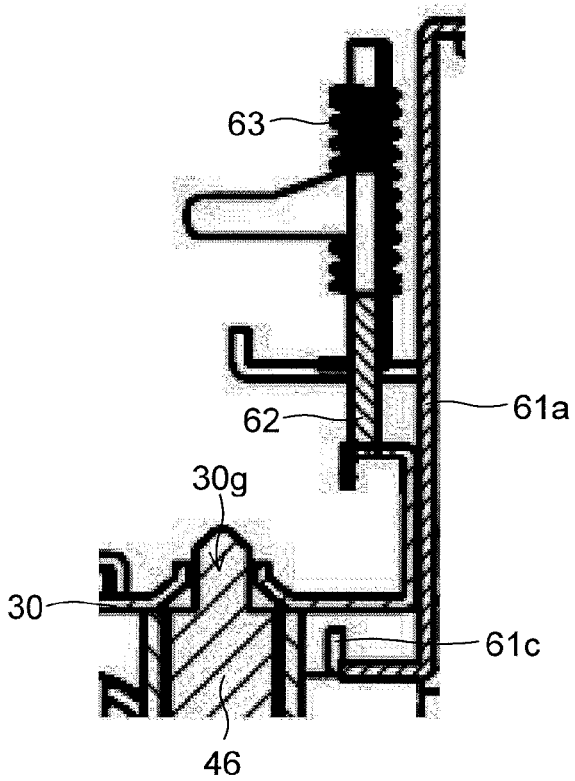
FIG. 25 is a partial enlarged view showing a part of FIG. 24.

Specifically, the wipe lifting motor 76 is rotated normally from the state shown in FIG. 20, and as a result, as shown in FIG. 24, the support arms 74 swing (rise) to cause the wipe unit 19 to move up further. Thereby, as shown in FIG. 25, the protruding portions 61*c* are disengaged from the first positioning holes 30*f*.

Figure 26:
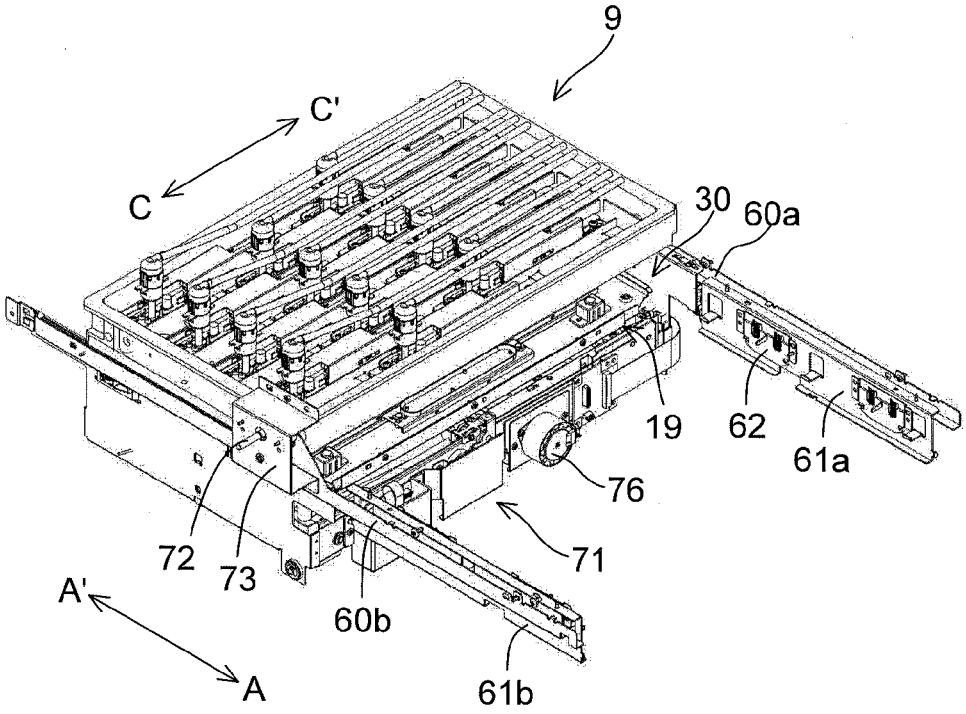
FIG. 26 is a perspective view showing a state in which the cap unit and the wipe unit of the printer according to the one embodiment of the present disclosure have moved to a first position.
Figure 27:
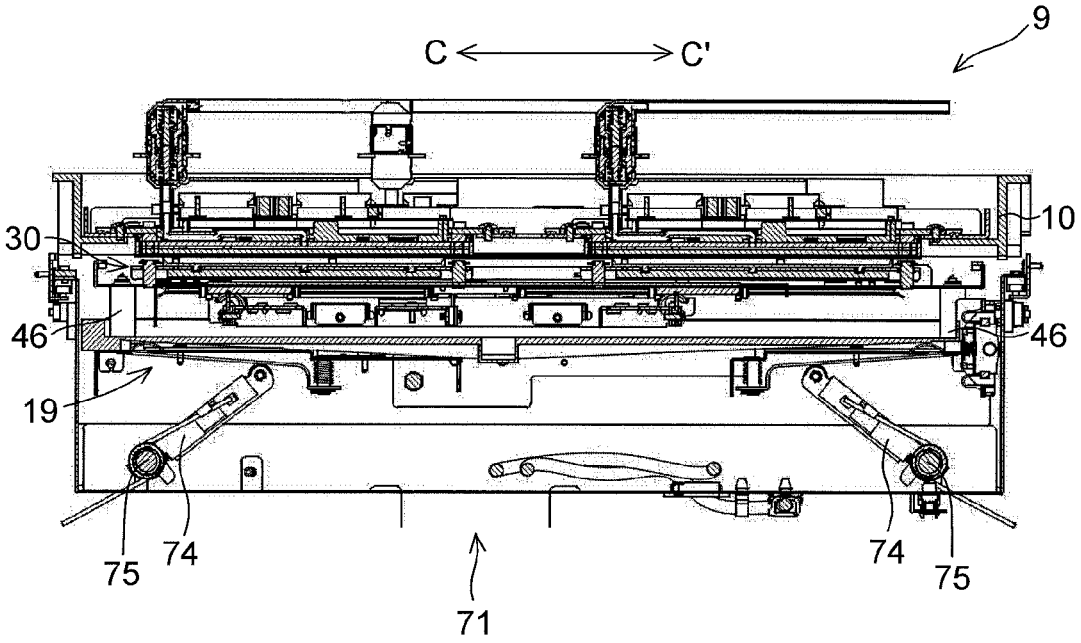
FIG. 27 is a sectional view showing a state in which the cap unit of the printer according to the one embodiment of the present disclosure has capped the recording head.

Then, the drive motor 72 rotates normally, and thereby, as shown in FIG. 26, the wipe unit 19 and the cap unit 30 are caused to move together horizontally from the second position to the first position. Thereafter, the wipe lifting motor 76 rotates normally, and as a result, as shown in FIG. 27, the support arms 74 swing (rise) further, so that the wipe unit 19 and the cap unit 30 move up together. Then, by stopping the rotation of the wipe lifting motor 76 at a time point when the cap unit 30 comes in intimate contact with the recording portion 9, capping of the recording heads 17*a* to 17*c* with the cap unit 30 is completed.

Here, the wipers 35*a* to 35*c* are kept pressed against the cleaning members 30*d* in the state shown in FIG. 22 while the wipe unit 19 and the cap unit 30 are moved from the second position to the first position to be moved up further thereafter. That is, during the course from the printing operation through the cap unit 30 attaching operation, the end portions of the wipers 35*a* to 35*c* are constantly maintained in a moist condition.

Next, a description will be given of a recovering process of the recording heads 17*a* to 17*c* in the printer 100 according to the present embodiment. When the recovering process of the recording heads 17*a* to 17*c* is performed by the wipe unit 19, as shown in FIG. 23, the first belt conveyance portion 5 which is arranged to face the lower surface of the recording portion 9 is lowered. Then, as shown in FIG. 28, with the cap unit 30 left at the second position, the wipe unit 19 is moved from the second position to the first position, and thereafter the wipe unit 19 is lifted up, to thereby bring the wipe unit 19 into contact with the recording heads 17*a* to 17*c*.

Figure 29:
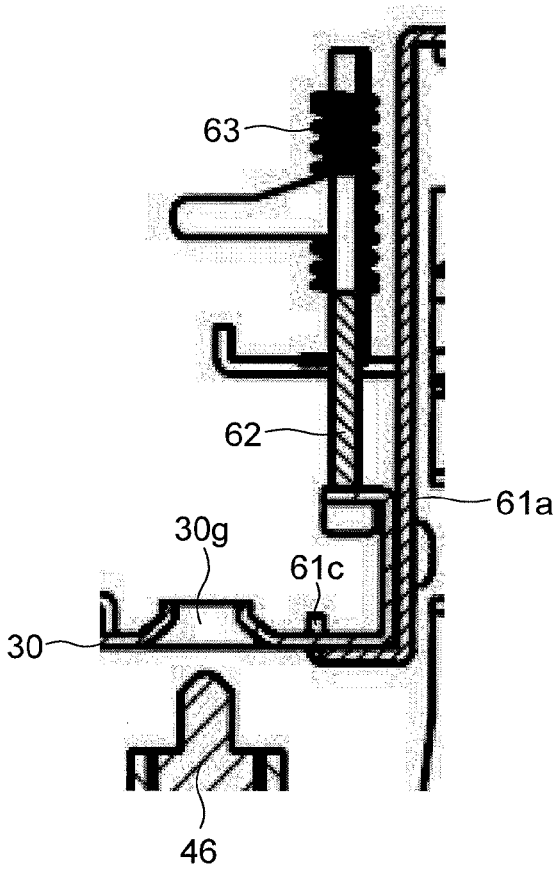
FIG. 29 is an enlarged sectional view showing a state in which the wipe unit of the printer according to the one embodiment of the present disclosure has moved down further from the state shown in FIG. 21.

Specifically, as a result of reverse rotation of the wipe lifting motor 76 from the state shown in FIG. 7 and FIG. 20, the support arms 74 swing (lie down) to cause the wipe unit 19 to move down. Thereby, as shown in FIG. 29, the cap unit 30 is supported by the guide plates 61*a* and 61*b* to stop moving down, while the wipe unit 19 moves down further. As a result, the height-direction positioning protrusions 46 come out of the second positioning holes 30*g* and thus are disengaged from the second positioning holes 30*g*.

Figure 28:
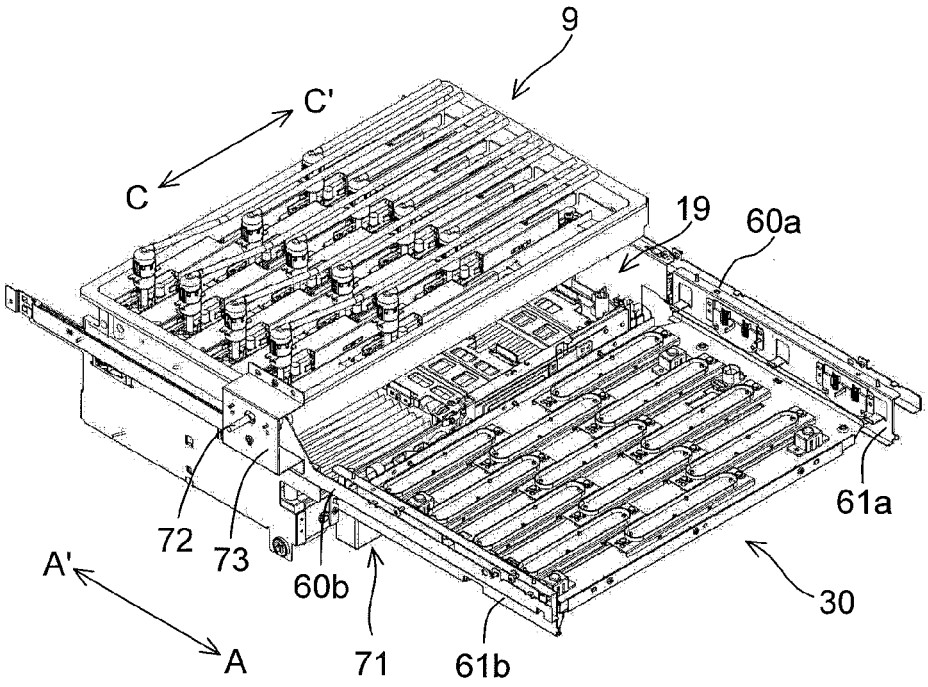
FIG. 28 is a perspective view showing a state in which the wipe unit of the printer according to the one embodiment of the present disclosure has moved to the first position.
Figure 30:
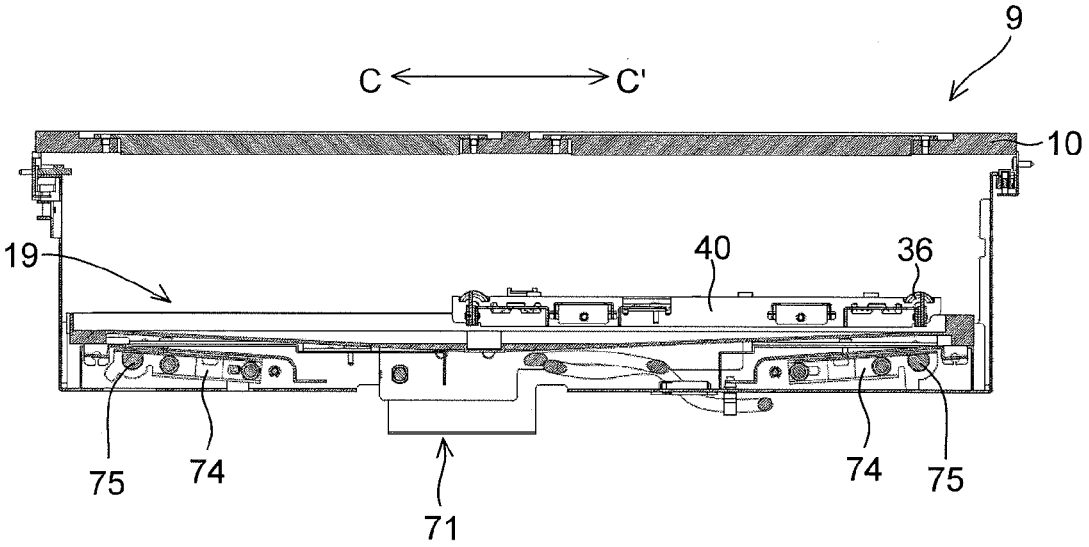
FIG. 30 is a sectional view showing a state in which the wipe unit of the printer according to the one embodiment of the present disclosure has moved to the first position.

Thereafter, the drive motor 72 rotates normally, and thereby, as shown in FIG. 28 and FIG. 30, the wipe unit 19 moves horizontally from the second position (position shown in FIG. 7) to the first position (position shown in FIG. 28).

Then, in advance of a wiping operation, in a state where no printing is being performed by the recording heads 17*a* to 17*c*, the inflow-side valve 27 (see FIG. 6) is closed and pressure is applied to the syringe pump 21 (see FIG. 6), to allow the ink 22 inside the cylinder 21*a* to flow through the second supply passage 25 to be supplied to the recording heads 17*a* to 17*c*. The thus supplied ink 22 is forcefully expelled (purged) from the ink ejection nozzles 18. By the purging operation, ink thickened inside the ink ejection nozzles 18, foreign matters, and bubbles are discharged, as a result of which the recording heads 17*a* to 17*c* can be recovered.

Figure 31:
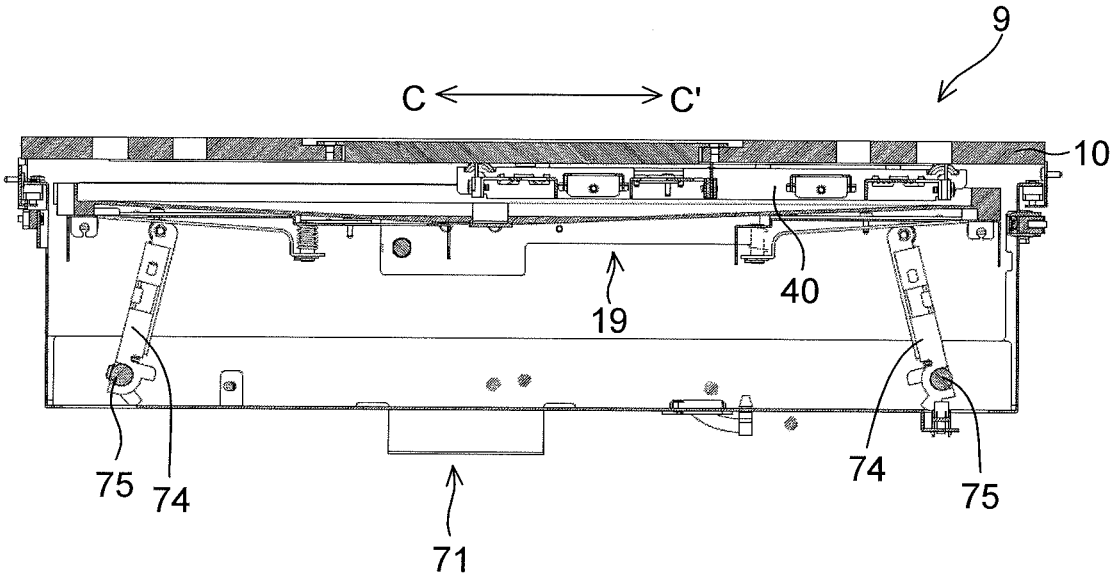
FIG. 31 is a sectional view showing a state in which the wipe unit of the printer according to the one embodiment of the present disclosure is performing a recovering process of the recording head.

Subsequently, the wiping operation is performed to wipe off the ink 22 expelled onto the ink ejection surfaces F. Specifically, the wipe lifting motor 76 rotates normally from the state shown in FIG. 30, and thereby, as shown in FIG. 31, the support arms 74 swing (rise) and the wipe unit 19 moves up to its highest position. Thereby, the wipers 35*a* to 35*c* fixed to the wiper carriage 31 are brought into press-contact with the ink ejection surfaces F of the recording heads 17*a* to 17*c* at wiping starting positions.

Then, by means of the wiper carriage moving motor 45 (see FIG. 17), the wiper carriage 31 is horizontally moved in the arrow C direction, allowing the wipers 35*a* to 35*c* to wipe off the ink expelled onto the ink ejection surfaces F of the recording heads 17*a* to 17*c*. The waste ink wiped off by the wipers 35*a* to 35*c* is collected on the ink collection tray 44 (see FIG. 17) arranged inside the wipe unit 19.

After the wipers 35*a* to 35*c* move to downstream ends of the ink ejection surfaces F of the recording heads 17*a* to 17*c*, when the wipe lifting motor 76 is reversely rotated, the support arms 74 lie down to cause the support frame 40 and the wiper carriage 31 to move down. Thereby, the wipers 35*a* to 35*c* are retracted downward from the ink ejection surfaces F of the recording heads 17*a* to 17*c*. Thereafter, as shown in FIG. 30, the wiper carriage 31 is moved in a direction (arrow C' direction) opposite to the wiping direction, to bring the wipe unit 19 back into its original state again.

The wipe unit 19, which is now positioned at the first position, is horizontally moved to below the cap unit 30 (the second position), and is then lifted up to a predetermined position, and this concludes the recovering process of the recording heads 17*a* to 17*c*.

According to the present embodiment, as described above, in the recovering process of the recording heads 17*a* to 17*c* performed by means of the wipe unit 19, after moving the wipe unit 19 from the second position to the first position by means of the wipe moving mechanism (the drive motor 72 and other components), with the cap unit 30 left at the second position, the wipe unit 19 is lifted up by means of the wipe lifting mechanism (the wipe lifting motor 76 and other components); and in capping of the recording heads 17*a* to 17*c* performed by means of the cap unit 30, after moving the wipe unit 19 and the cap unit 30 from the second position to the first position by means of the wipe moving mechanism (the drive motor 72 and other components), with the cap unit 30 located over the wipe unit 19, the wipe unit 19 and the cap unit 30 are lifted up by means of the wipe lifting mechanism (wipe lifting motor 76 and other components). Thus, by means of one moving mechanism and one lifting mechanism, both the recovering process and the capping of the recording heads 17*a* to 17*c* can be performed, and this helps make the printer 100 compact.

Furthermore, as described above, to a bottom of the cap unit 30, the cleaning members 30*d* are attached not only to absorb the ink 22 adhered to the wipers 35*a* to 35*c* but also to maintain the wipers 35*a* to 35*c* in a moist condition. Since this arrangement makes it possible, by lifting the wipe unit 19 by means of the wipe lifting mechanism (the wipe lifting motor 76 and other components), to press the wipers 35*a* to 35*c* against the cleaning members 30*d*, the wipers 35*a* to 35*c* can be cleaned and maintained in a moist condition easily.

Moreover, as described above, when at the second position, the wipers 35*a* to 35*c* can be maintained in a moist condition by being pressed against the cleaning members 30*d*. This makes it possible to prevent the wipers 35*a* to 35*c* from getting dried up during the printing operation, which is particularly advantageous.

Furthermore, as described above, in capping the recording heads 17*a* to 17*c* with the cap unit 30, when at the first position, the wipers 35*a* to 35*c* can be maintained in a moist condition by being pressed against the cleaning members 30*d*. This makes it possible to prevent the wipers 35*a* to 35*c* from getting dried up during the capping operation, which is particularly advantageous.

Moreover, as described above, the guide plates 61*a* and 61*b* are provided with the protruding portions 61*c*. This makes it possible to easily position the cap unit 30 at the second position.

Furthermore, as described above, the guide plates 61*a* and 61*b* are provided with the protruding portions 61*c* that project upward, and the compression coil springs 63 that bias the cap unit 30 downward. This makes it possible, by moving the cap unit 30 along the guide plates 61*a* and 61*b* from the first position to the second position, to bias the cap unit 30 downward by means of the compression coil springs 63 into engagement with the protruding portions 61*c* to thereby position the cap unit 30 easily.

Moreover, as described above, the wipe unit 19 is provided with the height-direction positioning protrusions 46 that engage in the second positioning holes 30*g* formed in the cap unit 30. This makes it possible to position the wipe unit 19 with respect to the cap unit 30 easily.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the number of the recording heads of the recording portion 9 is not limited to any specific number, and, for example, two recording heads, or, four or more recording heads may be arranged for each of the line heads 11C to 11K.

Furthermore, the embodiments described above have dealt with inkjet recording apparatuses using ink of four colors, namely, yellow, magenta, cyan, and black in order to obtain full-color images, but the present disclosure is applicable to inkjet recording apparatuses that use coloring ink of a different hue, or inkjet recording apparatuses that use a different number of colors. In such cases, the structures of the cap unit 30 and the wipe unit 19 may be modified, as necessary, according to the structure of the recording portion 9.

Moreover, the above embodiments described above have dealt with examples where, during the printing operation, both when capping is performed with respect to the recording heads 17*a* to 17*c* by means of the cap unit 30 and when the wipe unit 19 and the cap unit 30 are moved between the first and second positions, the wipers 35*a* to 35*c* are pressed against the cleaning members 30*d* to be maintained in a moist condition. The present disclosure, however, is not limited to this. The wipers 35*a* to 35*c* may be pressed against the cleaning members 30*d* as necessary to be maintained in a moist condition.

What is claimed is:

1. An inkjet recording apparatus, comprising:

a recording portion having a recording head that ejects ink onto a recording medium;

a cap unit that is capable of reciprocating between a first position directly below the recording portion and a second position retracted in a horizontal direction from the first position and that caps the recording head at the first position;

a wipe unit that is capable of reciprocating between the first position and the second position and that performs a recovering process of the recording head at the first position;

a wipe moving mechanism that moves the wipe unit in the horizontal direction;

a wipe lifting mechanism that is disposed below the wipe unit and moves the wipe unit in an up-down direction; and a carriage that is disposed below the wipe lifting mechanism and supports the wipe lifting mechanism and the wipe unit, wherein the wipe lifting mechanism includes a support arm that rises or lies down by swinging;

the wipe unit is, at the second position, arranged below the cap unit;

in a case where the recovering process of the recording head is performed by means of the wipe unit, the wipe unit is moved from the second position to the first position by means of the wipe moving mechanism with the cap unit left at the second position, and then the wipe unit is lifted up by means of bringing the support arm of the wipe lifting mechanism from a lying-down state into a risen state; and in a case where capping is performed with respect to the recording head by means of the cap unit, the wipe unit and the cap unit are moved from the second position to the first position by means of the wipe moving mechanism, with the cap unit located over the wipe unit, and then the wipe unit and the cap unit are lifted up by means of bringing the support arm of the wipe lifting mechanism from the lying-down state into the risen state.

2. The inkjet recording apparatus of claim 1, wherein the wipe unit has a wiper that wipes off ink adhered to the recording head; and to a bottom of the cap unit, there is attached a cleaning member that absorbs ink adhered to the wiper and also maintains the wiper in a moist condition.

3. The inkjet recording apparatus of claim 2, wherein at the second position, the wiper is maintained in a moist condition by being pressed against the cleaning member.

4. The inkjet recording apparatus of claim 2, wherein in the case where capping is performed with respect to the recording head by means of the cap unit, the wiper is maintained in a moist condition at the first position by being pressed against the cleaning member.

5. The inkjet recording apparatus of claim 1, further comprising a positioning member that has a positioning portion for positioning the cap unit at the second position.

6. The inkjet recording apparatus of claim 5, wherein the positioning member is a guide member that guide the cap unit when the cap unit reciprocates;

the positioning portion is a projecting portion that projects upward and engages in a first positioning hole formed in the cap unit; and the positioning member is provided with a biasing member that biases the cap unit downward at the second position.

7. The inkjet recording apparatus of claim 1, wherein the wipe unit is provided with an engagement portion that engages in a second positioning hole formed in the cap unit.

* * * * *